US006233926B1

(12) United States Patent
Bailey et al.

(10) Patent No.: US 6,233,926 B1
(45) Date of Patent: May 22, 2001

(54) APPARATUS AND METHOD FOR FILTERING PARTICULATE IN AN EXHAUST TRAP

(75) Inventors: John M. Bailey, Dunlap; Donald J. Waldman, Brimfield, both of IL (US)

(73) Assignee: Illinois Valley Holding Company, Dunlap, IL (US)

( * ) Notice: Subject to any disclaimer, the term of this patent is extended or adjusted under 35 U.S.C. 154(b) by 0 days.

(21) Appl. No.: 09/516,480

(22) Filed: Mar. 1, 2000

(51) Int. Cl.[7] ..... F01N 3/00

(52) U.S. Cl. ..... 60/295; 60/297; 60/311; 60/324; 60/303; 55/385.3; 55/341.2; 55/DIG. 30; 137/625.31

(58) Field of Search ..... 55/385.3, DIG. 30, 55/213, 217, 523, 283, 341.2; 60/295, 311, 303, 324, 297; 137/599, 115.13, 625.31; 251/318, 63, 63.6, 61.2, 249.5

(56) References Cited

U.S. PATENT DOCUMENTS

| | | | | |
|---|---|---|---|---|
| 4,415,344 | | 11/1983 | Frost et al. . | |
| 4,833,883 | | 5/1989 | Oda et al. . | |
| 4,840,028 | * | 6/1989 | Kusuda et al. | 60/303 |
| 4,987,738 | * | 1/1991 | Lopez-Crevillen et al. | 60/286 |
| 5,024,054 | * | 6/1991 | Barris et al. | 60/274 |
| 5,063,737 | * | 11/1991 | Lopez-Crevillen et al. | 60/286 |
| 5,065,574 | * | 11/1991 | Bailey | 60/274 |
| 5,171,337 | * | 12/1992 | Pollock | 55/284 |
| 5,212,948 | * | 5/1993 | Gillingham et al. | 60/288 |
| 5,293,742 | * | 3/1994 | Gillingham et al. | 60/288 |
| 5,566,545 | * | 10/1996 | Hijikata et al. | 60/274 |
| 5,809,777 | * | 9/1998 | Kawamura | 60/303 |
| 5,930,994 | * | 8/1999 | Shimato et al. | 60/274 |
| 5,930,995 | | 8/1999 | Watanabe et al. . | |
| 5,941,066 | | 8/1999 | Araki et al. . | |
| 5,956,944 | * | 9/1999 | Dementhon et al. | 60/274 |
| 5,966,928 | | 10/1999 | Igarashi . | |

* cited by examiner

*Primary Examiner*—Thomas Denion
*Assistant Examiner*—Binh Tran
(74) *Attorney, Agent, or Firm*—Husch & Eppenberger, LLC; Robert E. Muir; Richard J. Musgrave

(57) ABSTRACT

An apparatus and method are disclosed for removing or filtering particulate from an internal combustion engine exhaust and/or for regenerating through flow particulate traps with the incoming flow of exhaust gas. The particulate trap modules have through flow passageways with porous walls for filtering particulate in the exhaust gas. The passageways are regenerated by periodically passing the exhaust gas there through at a velocity sufficient to erode or dislodge the soot and/or ash. Apparatus is provided to separate, burn and store the dislodged soot and/or ash. Having devices and catalysts may also be used to aid in the removal of soot and/or ash.

53 Claims, 16 Drawing Sheets

APPARATUS AND METHOD FOR FILTERING PARTICULATE IN AN EXHAUST TRAP

BACKGROUND OF THE INVENTION

The present invention relates generally to the field of diesel or other internal combustion engine exhaust systems and, more specifically, to an apparatus and method for reducing the release of emissions and particulate into the atmosphere; and to an apparatus and method for regenerating exhaust traps by manipulating the exhaust through-flow.

Diesel or other internal combustion engine exhaust filtering systems are used to filter particulate from engine exhaust. Particulate contains, inter alia, ash and soot. Exhaust filtering systems reduce the escape of particulate and other emissions into the atmosphere. Federal and state regulations govern the maximum amount of particulate which can be released into the atmosphere. For example, the U.S. diesel emissions regulations for the years of 1999 and 2000 limited the release of particulate from highway tracks to be less than 0.1 g/Hp-Hr. Such regulations have resulted in intensive efforts during the last twenty years to reduce the amount of particulate emitted from the diesel engine exhaust stack. The preferred approach and the one which most effort has been expended, is to reduce the amount of particulate generated by the engines. Another approach has been to filter or trap the particulate matter from the exhaust gas stream prior to its release into the atmosphere. Due to stringent emission requirements, the development and improvement of practical and reliable particulate trap systems is desirable.

To reduce the amount of particulate matter being released into the atmosphere, and to meet federal and state regulations, diesel and other internal combustion engine exhaust is normally filtered through depth-type traps or porous ceramic monolithic particulate traps. The depth-type traps employ various types of filter media including but not limited to porous or fibrous ceramics or metals. Further, some employ catalytic coatings. The catalyzed depth-type traps filter the particulate and promote its combustion. However, they are relatively expensive. These catalyst coated depth-type traps can generate undesirable emissions.

Most of the effort has been directed toward trap systems that use a porous ceramic monolith that contains many passages somewhat like a honeycomb as illustrated in Frost et al., U.S. Pat. No. 4,415,344. The honeycomb section monoliths can be extruded, are relatively inexpensive and provide a large passage surface area for a given size trap. By plugging the exit ends of alternate passages and the entrance ends of the remaining passages, the exhaust gas is forced through the porous walls of the in-flow passages into the out-flow passages. The soot particles are removed from the dirty in-flow gas and collect in a layer which builds up on the walls of the passage; clean gas exits from the out-flow passages.

While these traps remove 95–98% of the particulate from the exhaust gas stream, pressure drop across the trap builds up due to the accumulation of the soot and ash. While the soot can be burned periodically by heating all or a portion of the exhaust gas, these entail considerable loss of energy and, more seriously, the heat of combustion of the soot leads to cracking and melting of the traps.

Complicated catalyst means have been used to lower the ignition temperature of the soot to protect the trap with mixed results but burnout does not prevent longer term accumulation and pressure drop due to the buildup of incombustible ash.

Oda et al., U.S. Pat. No. 4,833,883 and Igarashi, U.S. Pat. No. 5,966,928 illustrates a cross flow monolithic ceramic trap coupled with reverse flow of high pressure air to remove the soot and ash without combustion within the particulate trap system. The through-flow passages of the cross flow trap are used to direct the dislodged soot and ash to an electrical heater outside the trap to burn the soot and collect the ash. However, this system results in loss of engine efficiency because of the amount of high pressure air (approximately 115 psi) required. In addition, the use of high pressure air requires a rather heavy structure to provide adequate strength and has also led to problems with the trap seals and valves used to control the reverse flow of air.

Yasushi et al., U.S. Pat. No. 5,941,066 and Yoshimasa et al., U.S. Pat. No. 5,930,995 illustrate depth and honeycomb wall flow particulate trap systems respectively in close proximity to the engine. The soot that is collected by these traps is burned by the heat of the engine exhaust or by electrical heaters located in each trap. By means of special passages and control valves the engine exhaust pulses are periodically employed to create back flow through the traps to dislodge and remove accumulated ash.

SUMMARY OF THE INVENTION

It is a general object of the present invention to overcome one or more of the deficiencies described above.

An object of the present invention is to provide an apparatus and method for removing engine exhaust particulate and for regenerating particulate trap systems with the flow of incoming exhaust gas. Moreover, regeneration is completed without high pressure reverse flow to force out soot and/or ash and without high temperature burn-off of soot within the exhaust filtering system.

Another object is to provide an apparatus and method for filtering exhaust gas with a plurality of particulate traps that can be automatically regenerated without the need for a catalyst, separate heating element to burn off soot or high pressure reverse flow of air or other gases to dislodge soot and/or ash.

Another object is to provide an apparatus and method to remove particulate from the engine exhaust that is relatively simple and inexpensive and offers excellent reliability and durability.

Another object is to provide an apparatus and method to remove particulate that has minimal effect on engine performance. Specifically, an apparatus and method which produces minimal pressure drop across a particulate trap module and minimal back pressure on the engine.

Still another object is to provide an apparatus which includes a particulate trap system that is lightweight, and which can be installed or used within a vehicle's exhaust stack.

Yet another object is to provide an apparatus and method which includes a plurality of particulate trap modules connected by chambers wherein each particulate trap module is of the cross flow type comprising a plurality of tubular through flow passageways with porous walls.

Still another object is to provide an apparatus and method which includes at least one particulate trap module connected by chambers and each particulate trap module is of the cross flow type comprising at least one tubular passageway with porous walls. At least one particulate trap module is opened allowing exhaust gas to flow through the passageways to erode and/or dislodge soot and/or ash and the subsequent remaining particulate trap modules filter the exhaust gas.

Still another object is to provide an apparatus and method to remove particulate from engine exhaust that incorporates one particulate trap module containing a plurality of through flow passageways having porous walls through which some of the exhaust gas may pass and be filtered and then the filtered exhaust gas is passed through a clearance gap surrounding the through flow passageways into the atmosphere and wherein the remaining exhaust gas in the particulate trap module continues through the through the through flow passageways into a separation chamber.

In accordance with one aspect of the invention there is provided at least one particulate trap module of the cross flow type having at least one through flow passageway that has porous walls through which some exhaust gas may be filtered and exit through the clearance gap surrounding the through flow passageways and pass into the atmosphere in a cross flow manner and the remaining exhaust gas may continue through the through flow passageways and exit into a separation and surge chamber that has no other entrance or exit. Exhaust gas from a diesel or other internal combustion engine flows into a first end of the through flow passageways wherein a portion of the exhaust gas flows through the through flow passageways and exit through the exit end into the separation and surge chamber thus increasing its pressure to substantially equal that of the pressure from the engine and causing all of the exhaust gas to return to through flow passageways in between the pulses from the engine and to pass through the porous walls of the through flow passageways into the clearance gaps and thus pass into the atmosphere. The periodic pulses or intermittent flow from the engine causes exhaust gas to flow at a substantial velocity through the through flow passageways and exit into the separation and surge chamber thereby eroding and/or dislodging the accumulation of soot and ash on the walls of the through flow passageways and then carrying the particles into the separation and surge chamber. The temporary increase in pressure in the separation and surge chamber caused by the through flow causes the exhaust gas to pass back into the through flow passageways and pass through the porous walls filtering soot and/or ash and then pass the filtered exhaust gas into the atmosphere. The separation and surge chamber separates soot and/or ash from the exhaust gas and burns any soot.

Still another object of the invention is to provide an apparatus and method for regenerating the particulate trap modules using the exhaust gas flow and for removing engine exhaust particulate. As an alternative embodiment, the particulate trap system incorporates a single particulate trap module containing a plurality of through flow passageways with porous walls for filtering particulate from exhaust gas and rotary valve system to manipulate the flow of exhaust gas to the through flow passageways in a designated order to erode and/or dislodge soot and/or ash accumulation.

In accordance with another aspect of the invention there is provided a method and apparatus for assuring an adequate velocity of exhaust gas through at least one particulate trap module for eroding and/or dislodging soot and/or ash when the engine is operating at different speeds and under different conditions. For example, adequate velocity is obtained during low speed and low power output operation, high speed and high power output operation and during periods of operation between the low and high engine operating conditions.

In accordance with another aspect of the invention there is provided a method and apparatus for assuring an adequate velocity of exhaust gas through a plurality of particulate trap modules for eroding and/or dislodging the soot and/or ash when the engine is operating at different speeds and under different conditions. For example, adequate velocity is obtained during low speed and low power output operation, high speed and high power output operation and during periods of operation between the low and high engine operating conditions. Further, the velocity and pressure drop across the trap is not excessive when the engine is operated at high speed and power output.

In accordance with another aspect of the invention there is provided a method and apparatus for minimizing the pressure drop across the particulate trap module by incorporating a pressure relief valve. This pressure relief valve is applicable to all of those embodiments discussed wherein the regeneration flow is in series with the particulate trap modules.

In accordance with another aspect of the invention there is provided a method and apparatus for facilitating regeneration of the particulate trap modules by incorporating a heater. This heater is applicable to all of the embodiments discussed.

These, and other objects and advantages of the present invention, will become apparent as the same becomes better understood from the following detailed description when taken in conjunction with the accompanying drawings.

BRIEF DESCRIPTION OF THE DRAWINGS

Reference is now made to the drawings which illustrate the best known mode for practicing the steps of the method and apparatus which performs the method; and wherein similar reference characters indicate the same parts throughout the several views.

DETAILED DESCRIPTION

The following introduction serves to introduce terms used hereinafter. A particulate trap system includes, but is not limited to, an entrance port, valve chamber, valves, seals, partitions, through flow passageways, porous walls, particulate trap modules, end walls, distribution chamber, separation plates, separation tubes, high temperature heater (optional), pressure relief valve (optional), cap, clearance gaps, louvers, separation chamber, exit region and collection chamber. The particulate trap system is of the cross flow type.

A particulate trap module includes through flow passageways and porous walls. The particulate trap module is of the cross flow type. A through flow passageway includes a tubular through flow passageway with porous walls wherein the porous walls are used for filtering exhaust gas. Particulate is defined to include, among other things, soot and/or ash. Regeneration is the process by which the accumulation of particulate is removed from the through flow passageways.

Figure 1:
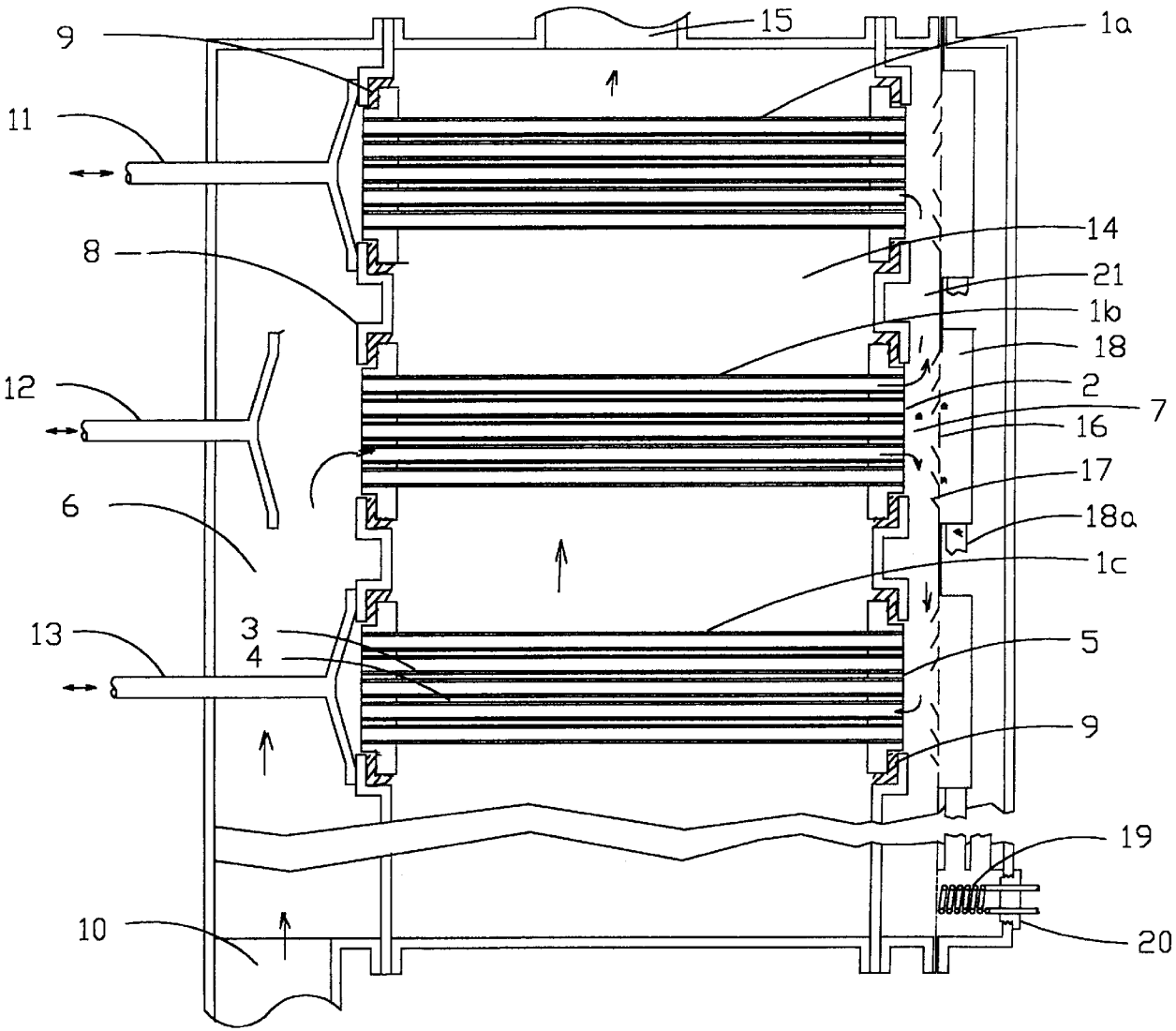
FIG. 1 is a sectional view of a particulate trap system containing a plurality of cross flow particulate trap modules arranged therein.

A particular trap system is shown in FIG. 1 in a vertical plane cross section. While a plurality of cross flow particulate trap modules can be incorporated; for simplicity, three cross flow particulate trap modules (1*a,* 1*b,* 1*c*) are illustrated. Each cross flow particulate trap module contains a plurality of through flow passageways (2) having porous walls (3) that are preferably made of cordierite ceramic. The through flow passageways (2) contain porous walls (3) which are used to filter exhaust gas. Clearance gaps (4) surround the through flow passageways (2) and are connected to a collection chamber (14) which leads to an exhaust stack (15). The clearance gaps (4) are sealed with end walls (5). The end walls (5) prohibit unfiltered exhaust gas from entering the clearance gaps (4) from valve chamber (6) or exit region (7) which is important because the exhaust gas in the valve chamber (6) and exit region (7) is unfiltered and the clearance gaps (4) lead to the exhaust stack (15) and then into the atmosphere. Therefore, the exhaust gas can only pass into the exhaust stack (15) after it has been filtered through the porous walls (3) of the through flow passageways (2). Partitions (8) and seals (9) are used to mount the cross flow particulate trap modules (1*a,* 1*b,* 1*c*) in place. The partitions (8) are recessed and the particulate trap modules (1*a,* 1*b,* 1*c*) are seated and sealed in place with the seals (9).

Diesel or other combustion engine exhaust gas enters the particulate trap system from entrance port (10) and passes into the valve chamber (6) that serves as a plenum chamber to provide a uniform flow of exhaust gas into the particulate trap modules (1*a,* 1*b,* 1*c*). A plurality of valves (11, 12, 13) are located at the entrance end of the particulate trap modules (1*a,* 1*b,* 1*c*) and through flow passageways (2). The number of valves and particulate trap modules can be varied and are dependent on the application and the regulatory requirements.

The valves (11, 12, 13) are independently operated and opened in a sequential manner. At least one valve is opened at all times but the number of closed valves can be varied depending on the application. In FIG. 1, valve (12) is shown as the open valve; however, each valve is at one time or another opened in sequence. The opening and closing sequence is arranged so that the next valve to be opened is the valve that has been closed the longest and the next valve to be closed is the valve that has been opened the longest. This ensures that the particulate trap module that has been closed; hence, filtering the longest is regenerated next. Further, the particulate trap module that was just regenerated is closed until all the other particulate trap modules are regenerated. The open valve allows the flow of exhaust gas at sufficient velocity through the through flow passageways (2) to erode and/or dislodge any soot and/or ash accumulation; hence, regenerating the particulate trap module. Further, some of the exhaust gas is also being filtered through the porous walls (3) of the through flow passageway (2) of the particulate trap module being regenerated.

Referencing FIG. 1, the exhaust gas enters the entrance port (10) into the valve chamber (6) and flows through the open valve (12) into the particulate trap module (1*b*). The velocity of the flow of exhaust gas through the through flow passageways (2) in the particulate trap module (1*b*) is quite high, approximately 50 feet per second or greater, throughout its lengths. This high velocity flow erodes and/or dislodges most of the soot and/or ash which has accumulated in the through flow passageways (2) during a prior period when valve (12) was in the closed position and either or both valve (11) and/or (13) were in the open position. A portion of the flow of exhaust gas is filtered through the porous walls (3) of the through flow passageways (2) of the cross flow trap (1*b*) because the static pressure in the gas flowing in the through flow passageways (2) is only a small amount less than the differential pressure across the trap (1*b*). This pressure differential may be approximately 15 inches $H_2O$ when first applied, rising to approximately 35 inches $H_2O$ and dropping to approximately 30 inches $H_2O$ as each particulate trap module (1*a*, 1*b*, 1*c*) is regenerated. This filtered exhaust gas flows into the clearance gaps (4) which surrounds the porous walls (3) and into a collection chamber (14) which is then passed through the exhaust stack (15) into the atmosphere. After the particulate trap module (1*b*) is regenerated, valve (12) closes and either valve (11 or 13) opens to start the regeneration process. The regeneration process is substantially continuous and applied to each particulate trap module (1*a*, 1*b*, 1*c*) sequentially to insure that the accumulation of soot and/or ash does not adversely affected engine performance.

The remaining unfiltered exhaust gas passes through the cross flow particulate trap module (1*b*) and exits the through flow passageways (2), turns 90° in the exit region (7) and enters into a distribution chamber (21) containing a separation plate (16) and louvers (17) for separating the soot and/or ash from the exhaust gas. Having flaked off the soot and/or ash on the passageway walls, most of the soot and/or ash particles exiting the through flow passageways (2) into the exit region (7) are large and massive relative to the tiny, dispersed particles entering the particulate trap system. The flow of exhaust gas turns sharply through a 90 degree angle and the large soot and/or ash particles are directed by inertia, the louvers (17) in the separation plate (16) and stagnation induced flow into a separation chamber (18). The separated soot and/or ash particles are carried from the separation chamber (18) by gravity and the stagnation induced gas flow through separation tubes (18*a*) to a high temperate igniter or heater (19) which ignites and burns the soot. Exhaust gas entering the area near the igniter (19) from the separation tubes (18*a*) returns via the separation tubes (18*a*) (not shown completely) to the separation chamber and exit regions of the particulate trap modules not undergoing regeneration. Ash does not ignite but collects along with the soot which is ignited and decomposed into a residue in the region around the high temperature igniter or burner (19). Accumulated ash can be disposed of periodically by unscrewing cap (20) on which the high temperature igniter (19) is mounted.

In FIG. 1, any soot and/or ash that does not enter the separation chamber (18) from particulate trap module (1*b*) is not emitted into the environment but is forced, along with the unfiltered exhaust gas, into the subsequent particulate trap modules (1*a* and/or 1*c*) and into the opposite end of the through flow passageways (2) that are blocked by the valves (11 and 12) for filtering through the porous walls (3). Any exhaust gas that is filtered through the porous walls (3) in the subsequent particulate trap modules (1*a*, 1*c*) enters the clearance gaps (4) and flows through the collection chamber (14) and exits through the exhaust stack (15) into the atmosphere. As flow continues to these particulate trap modules (1*a*, 1*c*), soot and/or ash accumulates on the inner surface of the through flow passageways (2) which causes pressure drop across the particulate trap modules (1*a*, 1*c*) and increased back pressure to the engine. Once again, this accumulation is removed by a subsequent regeneration process of the particulate trap modules (1*a*, 1*c*). This regeneration process was previously discussed for particulate trap module (1*b*) and is continually performed on any particulate trap module which has an open valve. The regeneration process for each trap continues until the exhaust back pressure to the engine reaches a predetermined level, a certain time period is reached, or some other parameter is reached. For example, valve (12) opens and valves (11 and 13) close allowing particulate trap module (1*b*) to regenerate. Once the predetermined back pressure level, time period, or some other parameter is obtained, valve 11 remains closed, valve (12) closes and valve (13) opens allowing particulate trap module (1*c*) to be regenerated. Once the predetermined level, time period or other parameter is obtained, valve (13) closes and valve (11) opens allowing particulate trap module (1*a*) to regenerate until the predetermined level, time period or other parameter is obtained. Once again, FIG. 1 shows only three cross flow particulate trap modules (1*a*, 1*b*, 1*c*) for illustration purposes only. A plurality of cross flow particulate trap modules and valves may be used. Further, the order of opening and closing the valves can be configured to open and close one or more valves at any one time and in any order. For example, there could be eight particulate trap modules and valves with two valves open and six closed until a predetermined level is obtained, and then the two valves close and other valves open. There are numerous particulate trap module and valve combinations with numerous rotational sequences which can be configured using this system.

The method of filtering and automatic regeneration are performed by manipulating the flow of exhaust gas through the through flow passageways (2) of the particulate trap modules by means of a valve system. The flow of exhaust gas is used to erode the layers of soot and/or ash build-up in the through flow passageways (2). Specifically, the flow of exhaust gas is applied to each particulate trap module on a rotating or sequential manner at a sufficient velocity to ensure that each particulate trap module is regenerated. Further, the flow of exhaust gas is strategically directed to the areas where the layers of soot and/or ash is the thickest. The flow of exhaust gas is directed into the through flow passageway (2) ends that were capped during a prior filtering. The ends of the through flow passageways (2) that are capped during the filtering process tend to accumulate the thickest layers of soot and/or ash. The method for regenerating the particulate trap modules with exhaust gas and for filtering particulate from the exhaust gas includes the steps of: passing exhaust gas through at least one particulate trap module containing tubular through flow passageways (2) with porous walls (3) at sufficient velocity to regenerate the particulate trap module wherein some of the exhaust gas is filtered during regeneration; blocking at least one particulate trap module to prevent regeneration with at least one valve; directing the unfiltered or remaining exhaust gas to enter the opened ends of the blocked particulate trap modules wherein the pressure builds within the passageways (2) forcing some of the remaining exhaust gas through the porous walls (3) into the atmosphere and filtering out the soot and/or ash; separating the eroded soot and/or ash from the flow of exhaust gas for external combustion and disposal; directing the remaining unfiltered exhaust gas to continue through the particulate trap system to at least one subsequent particulate trap module containing tubular through flow passageways (2) with porous walls (3) for filtering; and changing or alternating the exhaust flow between at least one particulate trap module by means of valves so that each particulate trap module is addressed by the aforementioned regeneration process.

In the first alternative method, the method for regenerating the particulate trap modules with exhaust gas and for filtering particulate from the exhaust gas includes the steps of: passing exhaust gas through a plurality of particulate trap modules containing tubular through flow passageways (2)

with porous walls (3) at sufficient velocity to regenerate the particulate trap module wherein some of the exhaust gas is filtered during regeneration; blocking a plurality of particulate trap modules to prevent regeneration with a plurality of valves; directing the unfiltered or remaining exhaust gas to enter the opened ends of the blocked particulate trap modules wherein the pressure builds within the passageways (2) forcing some of the remaining exhaust gas through the porous walls (3) into the atmosphere and filtering out the soot and/or ash; separating the eroded soot and/or ash from the flow of exhaust gas for external combustion and disposal; directing the remaining unfiltered exhaust gas to continue through the particulate trap system to a plurality of subsequent particulate trap modules containing tubular through flow passageways (2) with porous walls (3) for filtering; and changing or alternating the exhaust flow between a plurality of particulate trap modules by means of valves so that each particulate trap module is being addressed by the aforementioned regeneration or regeneration process.

The apparatus comprises: an entrance port for exhaust gas to flow into the particulate trap system; at least one particular trap module connected to chambers; a plurality of through flow passageways (2) having porous walls (3) contained within the particular trap modules for filtering particulate from the exhaust gas; and a valve system to manipulate the exhaust gas flow to the particulate trap modules in a designated order to erode the soot and/or ash accumulation.

Figure 2:
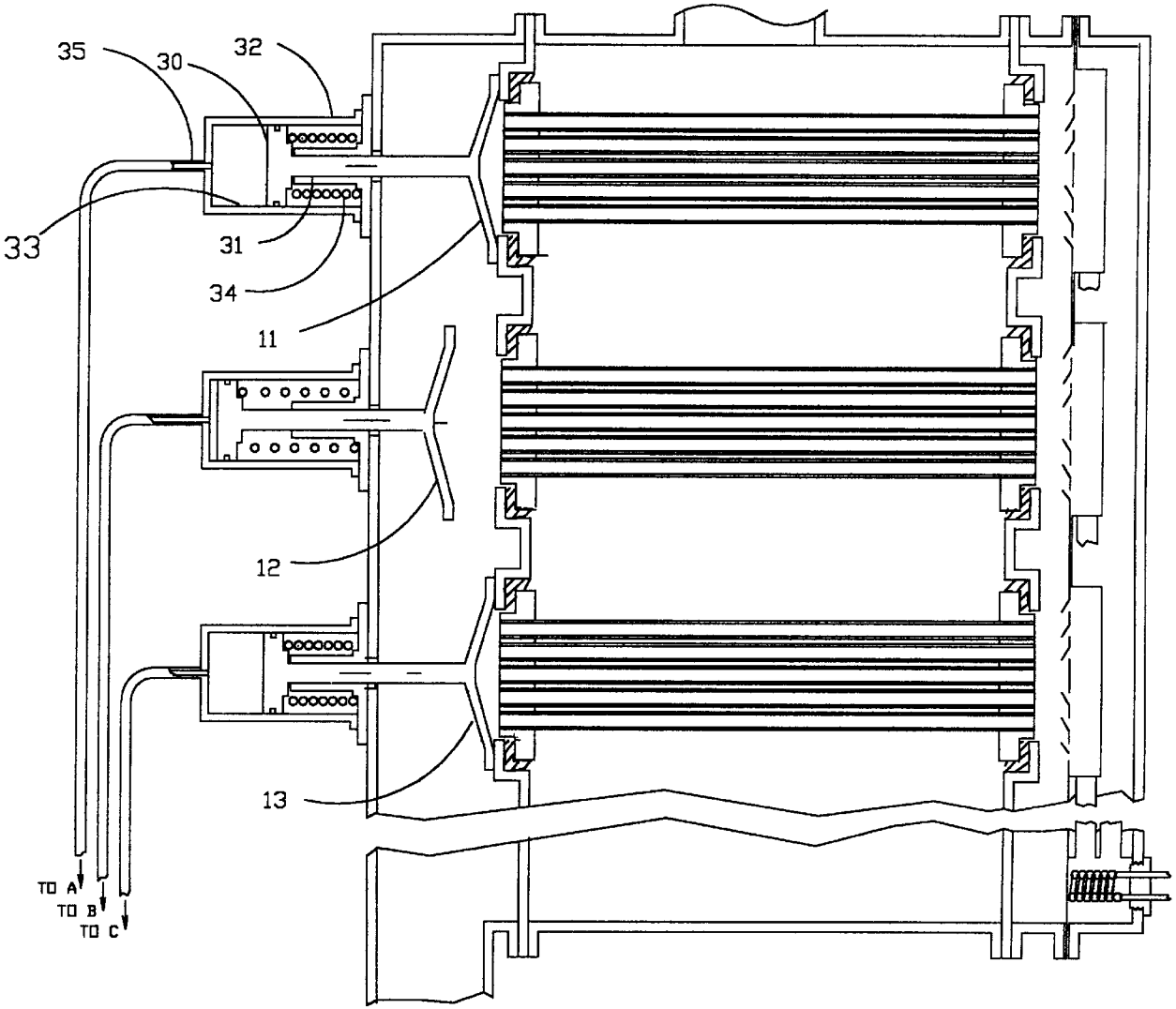
FIG. 2 is a sectional view of a first alternative embodiment of a particulate trap system containing a plurality of cross flow particulate trap modules in conjunction with pneumatically actuated valves arranged therein.

Turning now to FIG. 2 which illustrates a first alternative apparatus for FIG. 1. FIG. 2 illustrates a more specific apparatus and method containing valves (11, 12, 13) which are pneumatically actuated utilizing air pressure; for example air brake pressure when available on a machine. The air brake pressure provides adequate force and actuators (32) are well-suited to operate in a harsh environment such as in an exhaust system. Air pressure to energize the actuators (32) is controlled by a rotary valve shown in FIGS. 3*a* and 3*b* and will be discussed later. As previously explained, the function of the pneumatically actuated valves (11, 12, 13) is to control the exhaust flow in the particulate trap system wherein the flow of exhaust gas regenerates the particulate trap modules (1*a*, 1*b*, 1*c*).

The pneumatically actuated valves (11, 12, 13) are guided by a member (31) and are integrally attached to an actuator piston (30) which moves within cylinder (33). Air under pressure enters through an air tube (35) and forces piston (30) to compress or overcome the return force of spring (34); thereby, pushing the pneumatically actuated valves (11, 12, 13) into the closed position. The removal of the air pressure from the cylinder (33) results in spring (34) expanding; hence, pushing the actuator piston (30) toward the air tube (35) opening the pneumatically actuated valves (11, 12, 13). The air tubes (35) leading to the pneumatically actuated valves (11, 12, 13) are lettered to indicate the point on the control valve to which they are attached. It should be noted that the valves (11, 12, 13) need not be completely leak free upon closure; it is only necessary that they are sealed well enough to create a strong bias for the air to flow through the through flow passageways (2) of the particulate trap modules (1*a*, 1*b*, 1*c*) with a sufficient velocity to erode and/or dislodge the soot and/or ash accumulation. The apparatus and process described in FIG. 1 applies here except that means to actuate the valves (11, 12, 13) pneumatically is introduced.

Figure 3A:
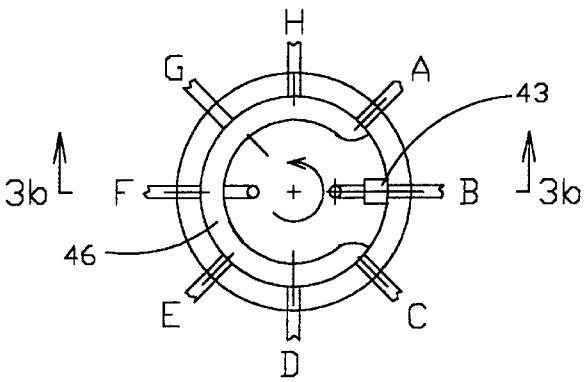
FIG. 3*a* is a cross sectional view of a rotary valve and taken generally along line 3*a*—3*a* of FIG. 3*b,* wherein the rotary valve is used to sequentially control pressurized air to hold closed at least one pneumatically actuated valve at a time.
Figure 3B:
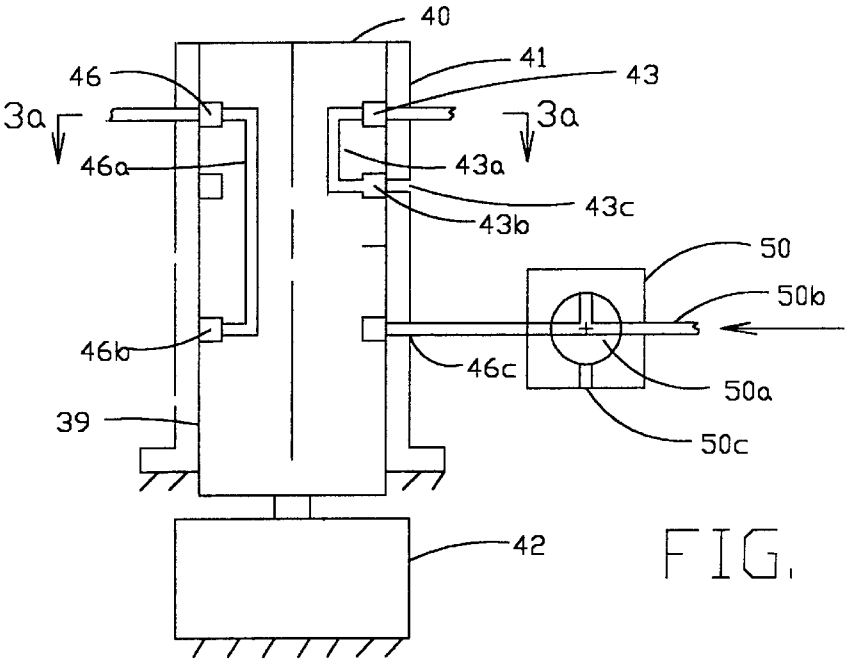
FIG. 3*b* is a diagrammatical longitudinal sectional view of the rotary valve in FIG. 3*a* and taken along line 3*b* —3*b*.

FIGS. 3*a* and 3*b* should be referred to in concert with FIG. 2 to illustrate the preferred embodiment of a rotary control valve (39) for a system that utilizes a plurality of traps. The rotary control valve (39) shown generally consists of a rotary valve member (40) that is fitted in a cylinder (41) with a tight clearance to minimize leakage. FIGS. 3*a* and 3*b* illustrate a particulate trap system consisting of eight particulate trap modules for simplicity. Once again, the number of particulate trap modules and valves can be varied. In the eight trap system shown, the rotor valve member (40) is periodically rotated 45 degrees counterclockwise by a stepping motor (42). In FIGS. 3*a* and 3*b*, it is assumed that only one pneumatically actuated valve opens at any given time to permit the flow of exhaust gas to erode and/or dislodge the soot and/or ash accumulation. Further, it is assumed that the rotary control valve (39) is connected to a particulate trap system containing eight particulate trap modules. Once again, the number of particulate trap modules, valves and control valves is varied depending on the application.

Pocket (43) registers with location "B," in this example and as shown in FIG. 3*a*, thereby connecting pocket (43) to air tube (35) (shown in FIG. 2) which leads to one of the actuators (32). However, the air pressure from the actuator (32) bleeds off through passages (43*a*, 43*b*, 43*c*) permitting the spring (34) (FIG. 2) to expand and pneumatically actuated valve (12) (FIG. 2) to open.

Conversely, relief pocket (46) registers with "A, C–H," in this example, thereby connecting relief pocket (46) to relief passages (46*a*, 46*b*, 46*c*) which permits air from the pressurized source to enter through a three-way valve (50); hence, closing all of the other pneumatically actuated valves when the actuators (32) are pressurized to overcome the spring (34).

As the rotary control valve (39) indexes through 45 degrees every time, interval pocket (43) sequentially registers with each of the lines (A–H) leading to the actuators (32) for the pneumatically actuated valves ( 11, 12, 13) resulting in one valve being opened at any one time. This assures that each particulate trap module is regenerated by being subjected to high velocity exhaust gas to erode and/or dislodge any accumulated soot and/or ash. The three-way valve (50) is electromagnetically opened against a spring (not shown) to the position shown when the key is actuated to start the engine. If power to the three-way valve (50) fails for any reason, the three-way valve (50) rotates counterclockwise 90 degrees by action of the return spring thus dumping all air pressure from the system through passageway (50*c*) and resulting in all valves opening to a safe position.

Figure 4A:
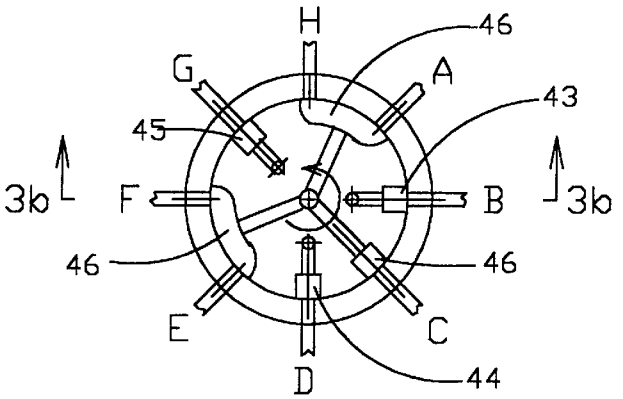
FIG. 4*a* is a cross sectional view of a first alternative embodiment of a rotary valve used to sequentially control pressurized air to hold closed a plurality of pneumatically actuated valves at a time in response to engine operating parameters to minimize pressure drop across the particulate trap module and back pressure on the engine.
Figure 4B:
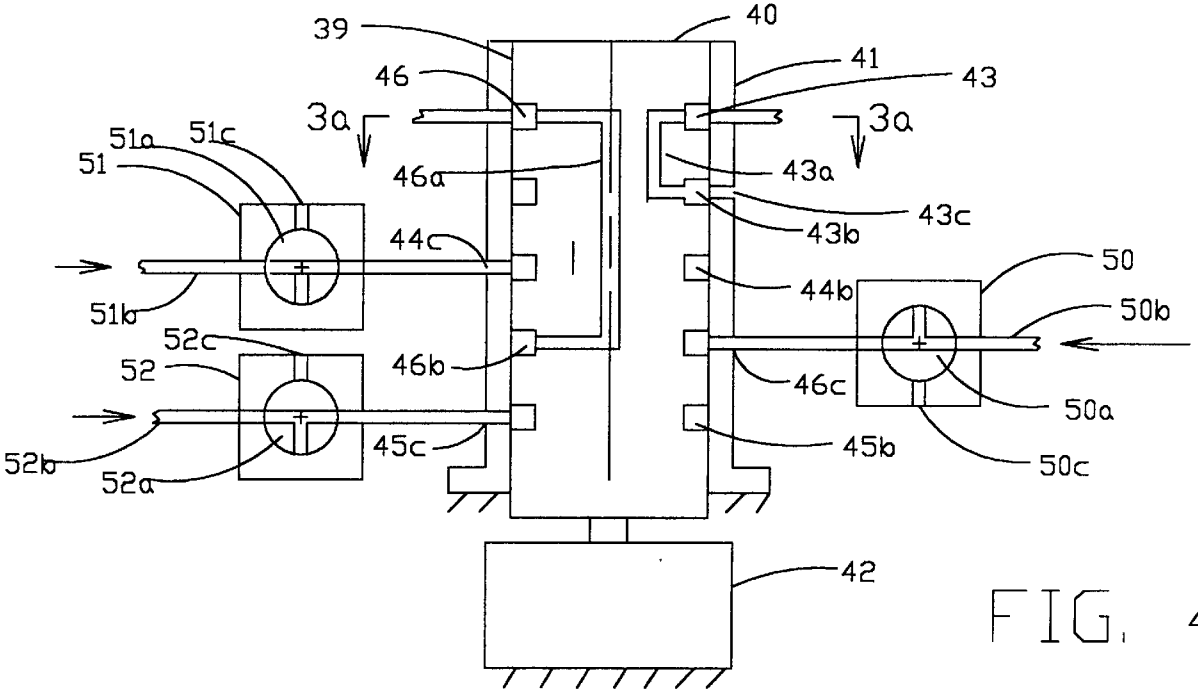
FIG. 4*b* is a longitudinal view of the rotary valve illustrated in FIG. 4*a*.

FIGS. 4*a* and 4*b* should be studied with FIG. 2 and illustrate a variation of the rotary control valve (39) that permits at least one pneumatically actuated valve to be open at any one given time to permit the flow of exhaust gas to at least one particulate trap module; hence, regenerating at least one particulate trap module at a time. Thus, at low engine loads and speeds only one pneumatically actuated valve would be open to assure that the flow through the particulate trap module would have sufficient velocity to erode and/or dislodge the soot and/or ash. However, at high engine loads and speeds, the flow of exhaust gas is much greater and results in greater than the desired velocity and pressure loss if only one particulate trap module is open. In this case, a plurality of pneumatically actuated valves open allowing flow through to a plurality of particulate trap modules so that the regeneration process is being performed at any one given time. The function of pocket (43) and its associated passages (43*a*, 43*b*, 43*c*) is to vent air pressure from an actuator (32) and thus open the pneumatically actuated valve consistent with the description of FIGS. 3*a* and 3*b*. This is also true for relief pocket (46) whose function is to pressurize and close pneumatically actuated valves. While additional relief pockets (46) are provided, each performs the same function as discussed with FIGS. 3*a* and 3*b* except that additional pockets have been provided to change the sequence at which various pneumatically actuated valves are closed.

The principal changes in FIGS. 4*a* and 4*b* are the addition of second relief pocket (44) and second associated passageways (44*a,* 44*b,* 44*c*), and third relief pocket (45) and third associated passageways (45*a,* 45*b,* 45*c*). The second relief pocket (44), second associated passageways (44*a,* 44*b,* 44*c*), third relief pocket (45) and third associated passageways (45*a,* 45*b,* 45*c*) serve much like pocket 43 to relieve pressure and thus open pneumatically actuated valves. However, pockets (44) and (45) is controlled by electromagnetic three-way valves (51 and 52, respectively) to either relieve pressure to open the pneumatically actuated valves with which they are registered or to provide pressure to close the actuators. Thus, as engine load and speed increases and the pressure through one particulate trap module becomes excessive, electromagnetic valve (51) is energized causing it to rotate 45 degrees counterclockwise thus closing off the air supply and opening vent (51*c*). This results in the pneumatically actuated valve to which "D" is directed being opened thus permitting the flow of exhaust gas through this particulate trap module, in addition, to the pneumatically actuated valve associated with pocket (43) and its actuator at "B" being open. The three-way valve (51) is de-energized by an appropriate switch that responds to a particular engine operating parameter such as pressure drop across particulate trap modules, back pressure on the engine, or a means of sensing engine load and speed. Third relief pocket (45) and the third associated passageways (45*a,* 45*b,* 45*c*) and three-way valve (52) perform a similar function when an appropriate switch is actuated by responding to a particular engine operating parameter such as pressure drop across particulate trap modules, back pressure on the engine, or a means of sensing engine load and speed. The arrangement as shown places the additional pockets more or less evenly spaced about the rotor. Thus, as engine load and speed increase, additional pockets (44) and (45) cause additional pneumatically actuated valves to open, to relieve pressure and to regenerate, more frequently, the through flow passageways of the particulate trap modules. This is desirable because the soot and/or ash in the through flow passageways accumulates more quickly under higher load and speed conditions, especially when under lug conditions.

Figure 5:
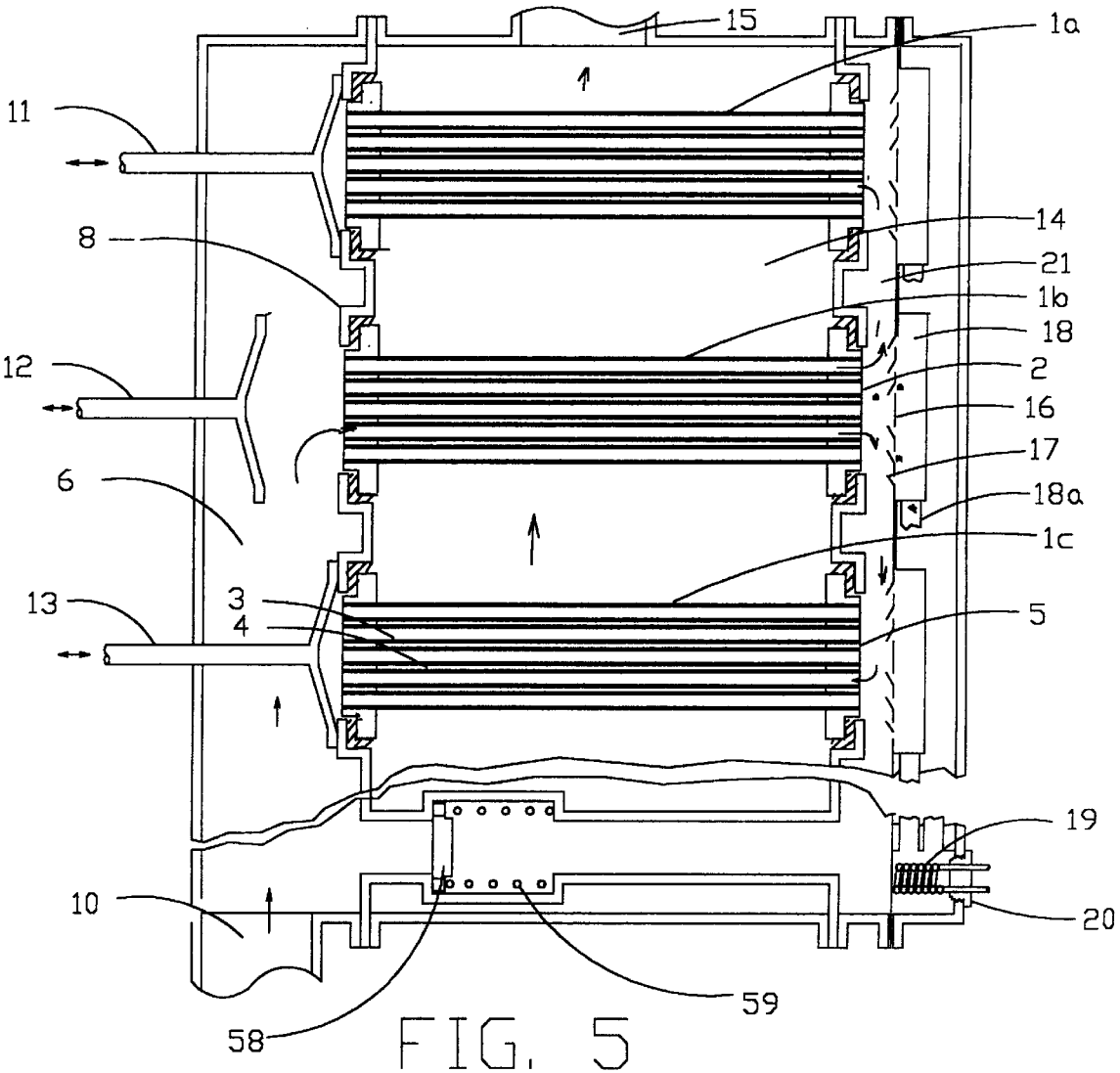
FIG. 5 is a sectional view of a particulate trap system containing a plurality of particulate trap modules in conjunction with a pressure relief valve to minimize pressure drop across the trap.

A particulate trap system in FIG. 5 is the same embodiment as shown in FIG. 1 but with the incorporation of a pressure relief valve (58) for a simpler control system. In FIG. 5, the pressure relief valve (58) provides an alternative way to prevent excessive pressure from occurring in the particulate trap system, excessive pressure drop across the opened particulate trap module (1*b*) and excessive back pressure on the engine. For example, under low load or intermediate operating conditions the velocity is sufficient and not excessive to adequately erode and/or dislodge soot and/or ash from the through flow passageways of one particulate trap module without excessive pressure drop across the particulate trap module or excessive back pressure being applied to the engine. Again, under low operating parameters, the exhaust gas enters entrance port (10) and passes into the valve chamber (6) and because valve (12) is open into particulate trap module (1*b*) eroding and/or dislodging soot and/or ash in the through flow passageways (2). However, as the engine exhaust flow increases due to, for example, an increase in engine load and speed, the flow of exhaust gas increases resulting in excessive pressure drop across the particulate trap module and back pressure being applied to the engine. However, under high or extreme operating parameters, the pressure drop across particulate trap module (1*b*) and back pressure on the engine may become excessive, thus pressure relief valve (58) is incorporated to relieve pressure in the particulate trap system when a certain predetermined pressure limit is reached. This predetermined limit is a function of the particular pressure relief valve and can be selected based on the particular application. Once again, when pressure in the particulate trap system reaches a desired limit, the pressure relief valve (58) is forced open permitting exhaust gas to bypass the particulate trap module (1*b*) that is open. This exhaust gas flows directly into the distribution chamber (21) and then enters the particulate trap modules (1*a,* 1*b,* 1*c*) for complete filtration. It should be noted that this bypass in no way reduces the velocity of the gas flowing through the particulate trap module (1*b* in this illustration) being regenerated, nor is it emitted as unfiltered gas into the atmosphere.

Figure 6:
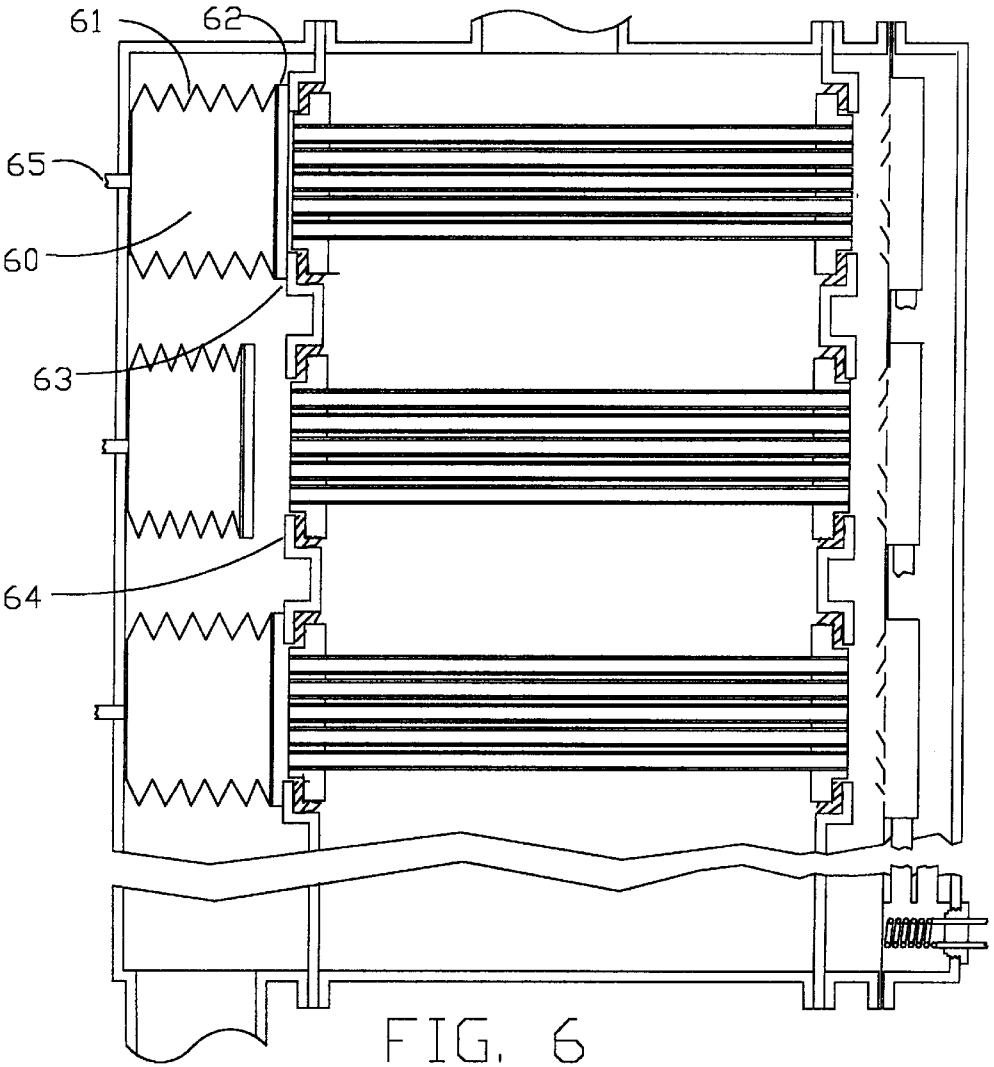
FIG. 6 is a sectional view of a second alternative embodiment of a particulate trap system containing a plurality of particulate trap modules in conjunction with an alternative design of pneumatically actuated valves.

FIG. 6 illustrates a second alternative embodiment for the particulate trap system shown in FIGS. 1 and 2 but with an alternative design for pneumatic valves (60). The pneumatic valves (60) consist of high temperature bellows (61) that are attached to plates (62) that seat against seat areas (63) of partitions (64). Tubes (65) lead from the pneumatic valves (60) to the rotary pneumatic control valve (39) that was previously discussed. The advantage of this arrangement is that there are no sliding fits, pistons, etc. that could possibly fail and reduce reliability. Further, fewer parts and machine services lowers the cost to manufacture.

Figure 7:
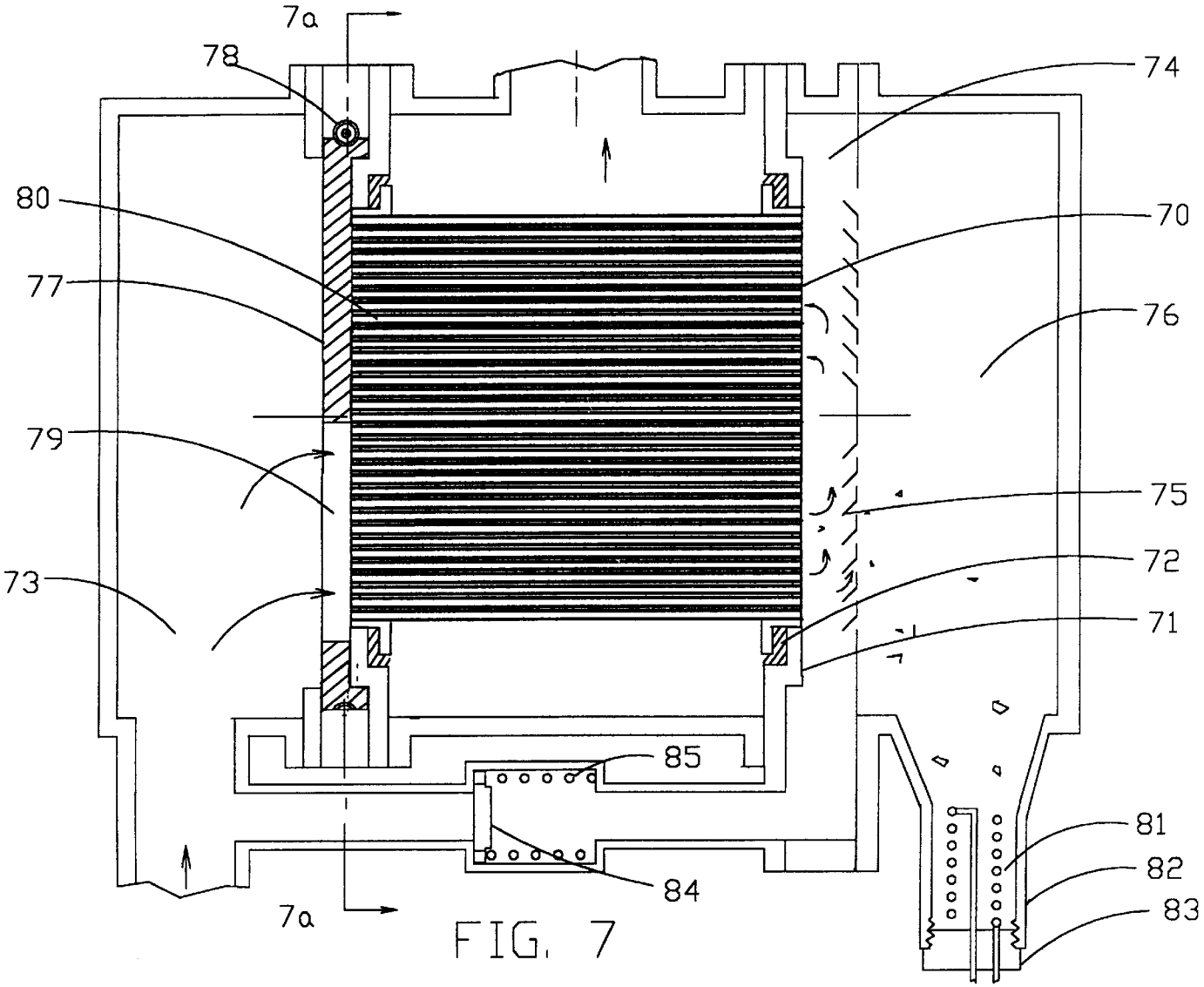
FIG. 7 is a sectional view of a particulate trap system with a single particulate trap module in conjunction with a pressure control device to control maximum pressure drop across the particulate trap module arranged therein.

FIG. 7 illustrates a particulate trap system with a single cross flow particulate trap module (70) containing through flow passageways (80) having porous walls rather than the plurality of particulate trap modules previously discussed. Similar to the other embodiments previously discussed, the single cross flow particulate trap module (70) is regenerated by the flow of exhaust gas. Further, the exhaust gas is filtered through the porous walls of the through flow passageways (80). The significant difference is in the way that the through flow passageways (80) of the single cross flow particulate trap module (70) are regenerated. In the previously discussed arrangements, the flow of exhaust gas passes into an open valve and through all of the porous tubular through flow passageways in a given particulate trap module to erode and/or dislodge soot and/or ash. Some of the exhaust gas is filtered through the porous walls of the passageways in the particulate trap module being regenerated and the remaining flow of exhaust gas passes into subsequent particulate trap modules in return flow fashion for complete filtration.

In the single cross flow particulate trap module (70), a rotary plate valve (77) allows the flow of exhaust gas to pass into a plurality of porous tubular through flow passageways (80). This flow regenerates the through flow passageways (80). Some of the exhaust gas is filtered through the porous walls of the through flow passageways (80). The remainder of the exhaust gas flows out the through flow passageways (80) and enters a distribution chamber (74). The soot and/or ash blown out of the through flow passageways (80) during regeneration is directed toward louvers (75) by inertia as the flow direction is abruptly changed and is caught by the louvers (75) and then passed into the separation chamber (76) along with a small amount of exhaust gas. Flow velocities in the separation chamber (76) is very low and relatively large chunks of soot and/or ash settle by gravity into an igniter chamber (82) where the soot is ignited by electrical high temperature ignition coils (81).

The electrical high temperature igniter coils (81) ignite soot upon contact. The ignition results in ash which collects in the igniter chamber (82) where it is temporarily stored until removal is accomplished by removing cap (83).

The remaining exhaust gas continues flowing into the distribution chamber (74) and is turned through a 180 degree and then enter the blocked through flow passageways (80) in return flow fashion for complete filtration. The through flow passageways (80) have porous walls which allow the exhaust gas to pass into clearance gaps while filtering out any soot and/or ash and then into the atmosphere. These blocked through flow passageways (80) will need to be regenerated due to the settling soot and/or ash during filtering. While the embodiment is different, the filtering action is the same as in the previous described embodiments.

Figure 7A:
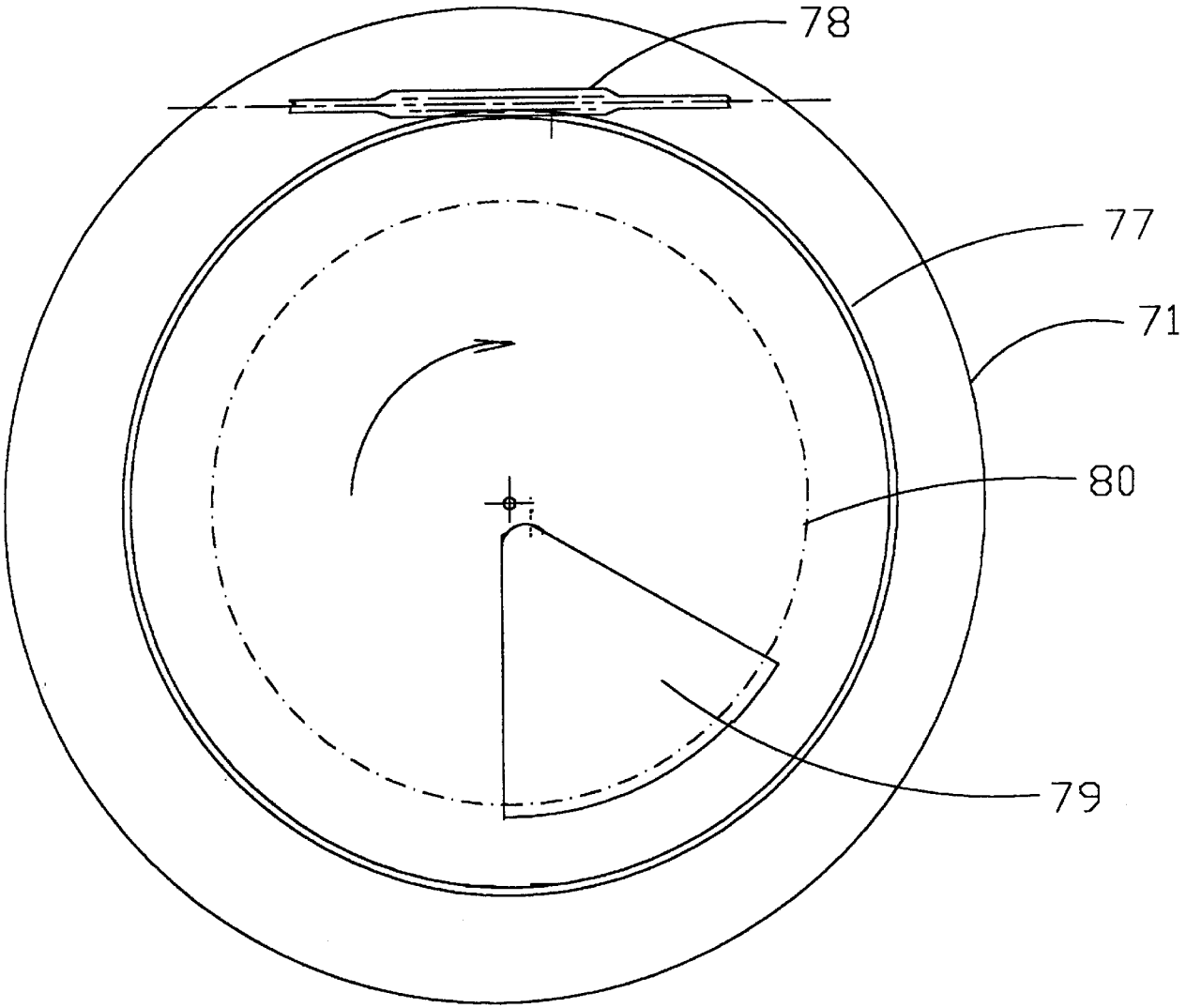
FIG. 7*a* is a cross sectional view of a rotary valve with a cutout so that the flow of exhaust gas passes through the aperture to the porous tubular through flow passageways to remove the layer of soot and/or ash build up for the embodiment illustrated in FIG. 7.

Referring to FIGS. 7 and 7*a,* the single cross flow particulate trap module (70) is located in structure (71) and sealed by a high temperature sealing compound (72), such as expanded vermiculite. Exhaust gas enters an entry chamber (73) and is directed into an aperture (79) of rotary valve plate (77) as shown by the arrows and into the through flow passageways (80). This flow regenerates the open through flow passageways (80). The rotary plate valve (77) is fitted against the entry face of a plurality of through flow passageways (80) of the single cross flow particulate trap module (70) with a tight clearance and is rotated at an appropriate speed by a worm gear (78) and related drive motor (not shown). The shape of the aperture (79) is shown in FIG. 7*a.* The outline of the single cross flow trap module (70) diameter is shown in phantom lines (80) in FIG. 7*a.* As this rotary plate valve (77) rotates, it prevents exhaust gas flow from entering a plurality of through flow passageways (80) thereby increasing the velocity of exhaust gas flow into the aperture (79) and the unobstructed through flow passageways (80) to facilitate the erosion or dislodging of soot and/or ash. The aperture (79) exposes approximately one-sixth of the porous tubular through flow passageways (80) in the single cross flow trap module (70). The velocity is quite high at approximately 50 feet per second or even greater at low engine loads and speeds and this is sufficient to dislodge any collected soot and/or ash deposits by erosion.

Regeneration of the single cross flow particulate trap module takes place when the rotary plate valve (77) rotates because the aperture (79) is constantly moved thus the through flow passageways (80) subjected to the high velocity of exhausts gas are continually changed. As the rotary plate valve (77) rotates, the through flow passageways (80) that were previously regenerated are covered to prevent through flow of exhaust gas and thus serve as the filter by reverse flow. Further, as the rotary plate valve (77) rotates, different through flow passageways (80) are regenerated. This rotary plate valve (77) ensures that the most recently regenerated through flow passageways (80) is regenerated last.

A pressure relief valve (84) and a retention spring (85) are attached to entry chamber (73) to provide a bypass of the through flow passageways (80) that are being regenerated during high engine loads and speeds in a manner and for the reasons similar to the plurality of particulate trap modules previously discussed. The pressure relief valve (84) permits exhaust gas flow to bypass the through flow passageways (80) being regenerated and pass directly into a distribution chamber (74) in tangential fashion by an appropriately arranged duct (86) when the pressure in the particulate trap system exceeds certain limits. By having the flow from the pressure relief valve (84) entering the distribution chamber (74) in a tangential fashion, the flow of exhaust gas swirls around the distribution chamber (74) before passing into the through flow passageways (80) for complete filtration. This reduces the disruption from the bypass on the separated soot and/or ash particles.

Figure 8:
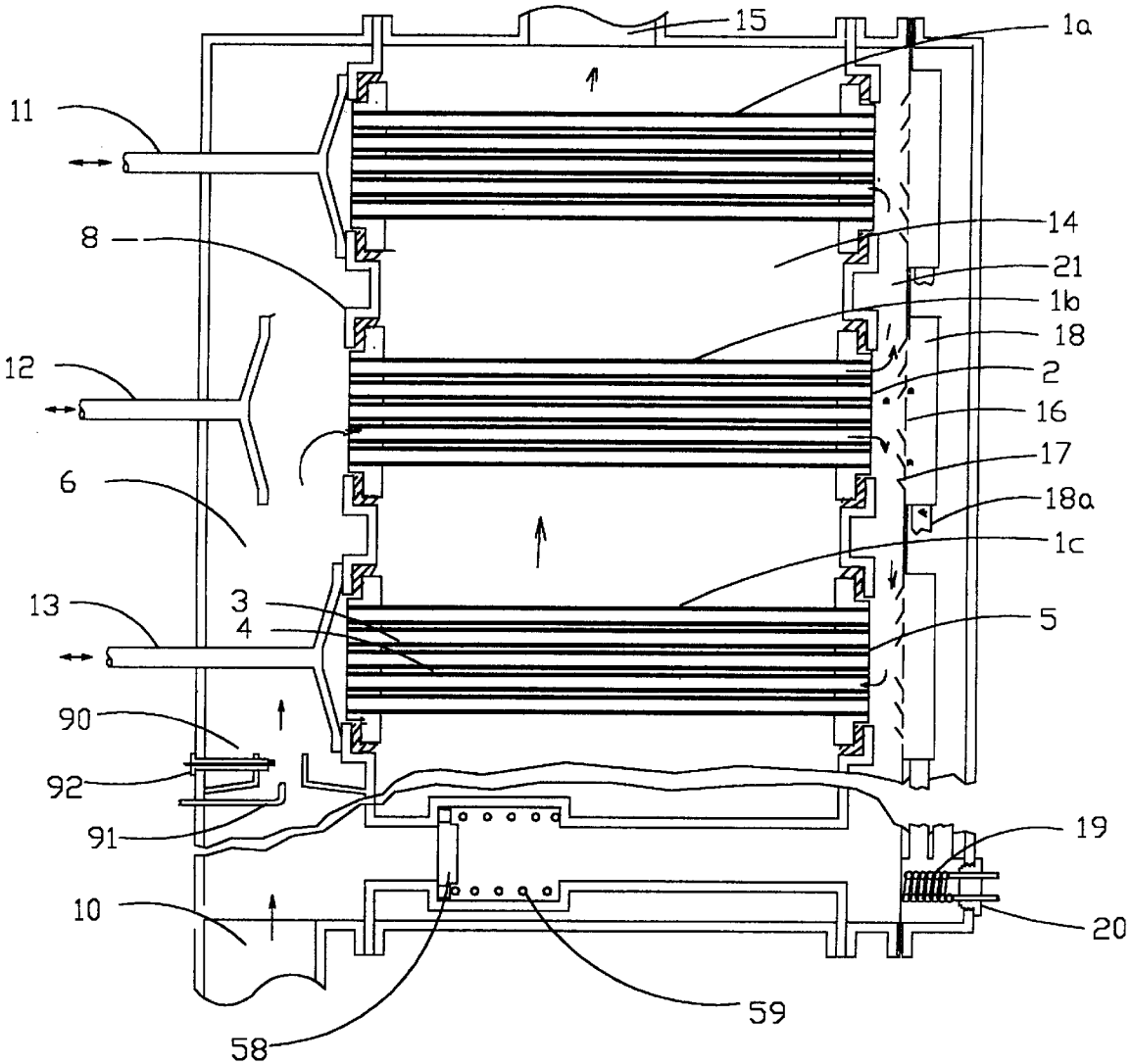
FIG. 8 is a sectional view of a particulate trap system containing a plurality of particulate trap modules in conjunction with an optional burner to facilitate the removal of soot and/or ash.

FIG. 8 illustrates a method and apparatus for providing an external burner or electrical heat source to facilitate the regeneration of the particulate trap modules (1*a,* 1*b,* 1*c*) under certain extreme engine operating conditions for any of the embodiments previously disclosed or soon to be disclosed. An example of extreme operating conditions is when operating at low idle especially during cold weather. The external heat source could be a burner or electrical heater (90) and this general approach has been used by others but, as mentioned earlier, has generally resulted in particulate trap system failures caused by overheating due to the combustion of collected soot. Failures of this type will not occur with the particulate trap systems disclosed herein because the through flow passageways are regenerated frequently by erosion, and the velocity of heated exhaust gas through the particulate trap system will augment the erosion process carrying both unburned soot and the heat from partially burned soot out the end of the particulate trap module thus preventing excessive temperature from occurring within the particulate trap system.

In the arrangement shown in FIG. 8, a burner (90) consists of a tube or nozzle (91) to inject fuel in a fine spray to be mixed with the oxygen rich exhaust gas stream. Sparkplug (92) is positioned to ignite the fuel spray. There are the usual temperature sensors to shut off the fuel in the event that ignition does not occur. This type of burner is quite common and no further details of its design are considered necessary. The burner (90) is shown as it would be applied to the particulate trap system that uses a plurality of particulate trap modules and employs an optional pressure relief valve to bypass the exhaust gas at high engine loads and speeds as previously discussed with respect to FIG. 5; however, the burner (90) could be used with any of the embodiments that have been and will be discussed. The burner (90) is located after the exhaust entry chamber (10) and pressure relief valve (58). This is significant because the total cross-sectional area of the through flow passageways (2) that are periodically regenerated is selected to assure that there is adequate flow velocity to achieve erosion and dislodging of soot and/or ash under low engine loads and speed. Under these conditions the flow of exhaust gas is relatively low and the gas stream can be heated to a high temperature with relatively low energy required. When the engine moves to high load and speed, the flow of exhaust gas is much greater but some of the exhaust is bypassed through the pressure relief valve (58) ahead of the burner (90) and is not heated. Because of the relatively low energy required for this function, an electrical heater could also be used. It should be noted that the burner (90) previously explained could also be used with the embodiment shown in FIG. 7. The burner (90) would be located prior to the single cross flow particulate trap module (70) but after the pressure relief valve (84).

Figure 9:
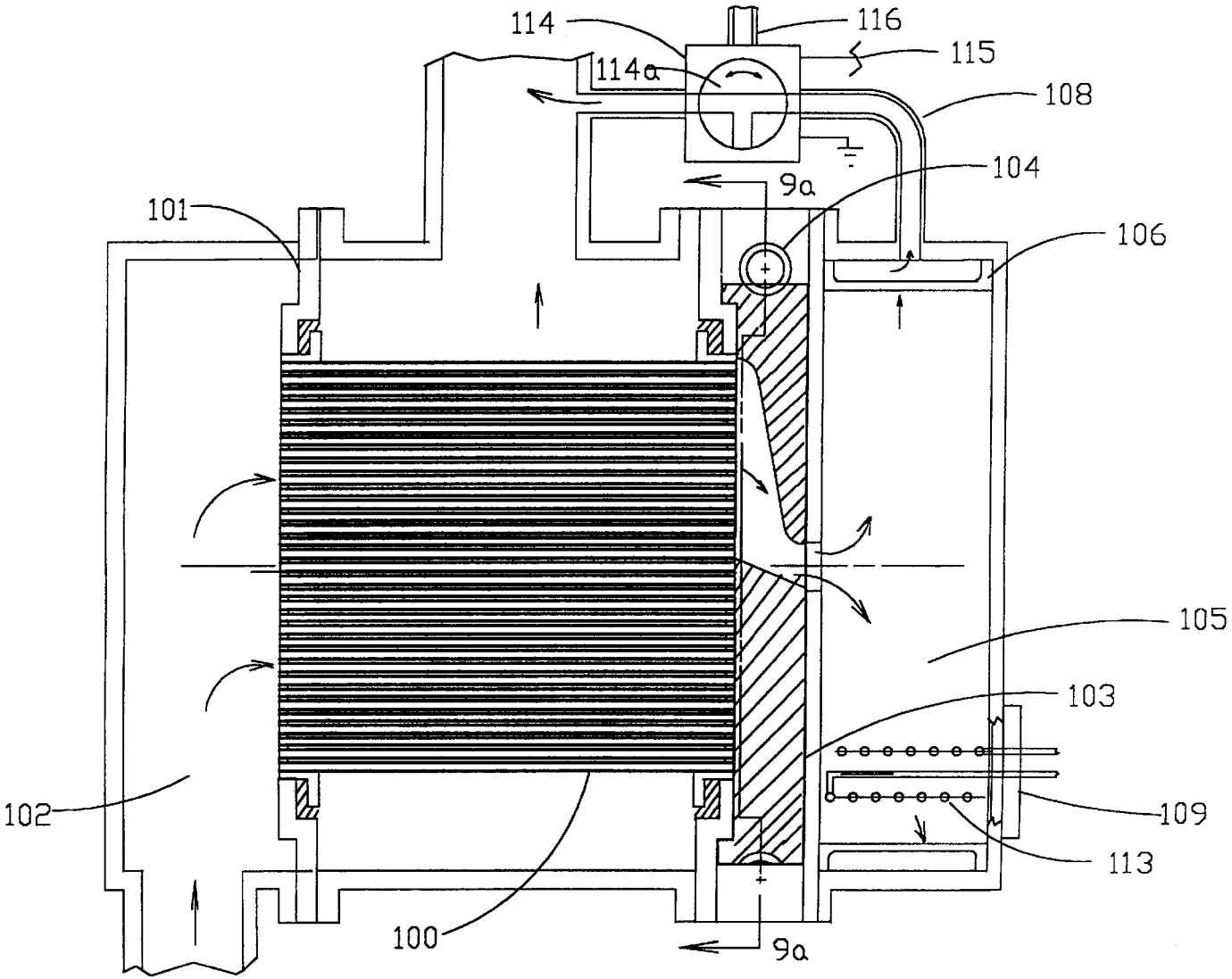
FIG. 9 is a sectional view of a first alternative embodiment of a particulate trap system with a single particulate trap module and a rotary valve operated to sequentially allow the flow of exhaust gas to enter the porous tubular through flow passageways to erode and/or dislodge the layer of soot and/or ash accumulation.

FIG. 9 illustrates a first alternative embodiment of a single cross flow particulate trap module (100). The single cross flow particulate trap module (100) is mounted to a structure (101). Again, regeneration takes place by passing the exhaust gas through the opened through flow passageways at a high velocity to erode any accumulated soot and/or ash. The exhaust gas enters an entry chamber (102) and then enters into the through flow passageways for filtering. The filtering takes place by passing most of the exhaust gas through the blocked through flow passageways having porous walls which filters out the particulate but allows exhaust gas to pass into the clearance gaps releasing the filtered exhaust gas into the atmosphere. Further, filtering takes place by passing the remainder of the exhaust gas through the through flow passageways, that are not blocked, having porous walls which filters out the particulate but allows exhaust gas to pass into the clearance gaps releasing the filtered exhaust gas into the atmosphere. The remaining exhaust gas that does not get filtered passes from the unobstructed through flow passageways (2) carrying with it soot and/or ash dislodged from the through flow passageways (2) into the separation chamber (105) thus regenerating those though flow passageways (2). As illustrated in FIG. 9, a rotary valve (103) is mounted at the exit ends of the tubular through flow passageways. Once again, for the blocked through flow passageways, the exhaust gas is forced through the porous walls whereby filtration occurs. This process results in the accumulation of soot and/or ash on the inner surface of the through flow passageways that are blocked.

Regeneration is effected by rotating the rotary valve (103) by a worm gear (104) that is driven by a motor (not shown) or other suitable means. As the rotary valve (103) rotates around the exit ends of the through flow passageways, some of the through flow passageways that are blocked by the rotary valve (103) open allowing exhaust gas to enter at sufficient velocity to erode the accumulated soot and/or ash; hence, regenerating the through flow passageways. The rotation of the rotary valve (103) ensures that each through flow passageway is regenerated. Further, as the rotary valve (103) rotates, the through flow passageways that are not blocked will be blocked. The blocked through flow passageways then continue to filter soot and/or ash until opening for another regeneration at a later time.

The filtering process takes place in one of two ways. First, most of the exhaust gas entering the through flow passageways from the exhaust gas entry chamber (102) is forced through the porous walls of the through flow passageways into the exhaust stack and into the atmosphere. Secondly, the remaining exhaust gas passes through the unblocked through flow passageways regenerates them, carrying the large soot particles into the separation chamber (105) to settle toward an igniter (113) or be filtered through an annular porous ceramic or fibrous secondary filter (106) which filters soot and/or ash. The exhaust gas passing through the secondary filter (106) passes into a passage (108) into the exhaust stack and on into the atmosphere. Both filtering flow paths result in no exhaust gas passing to the atmosphere without being filtered.

Figure 9A:
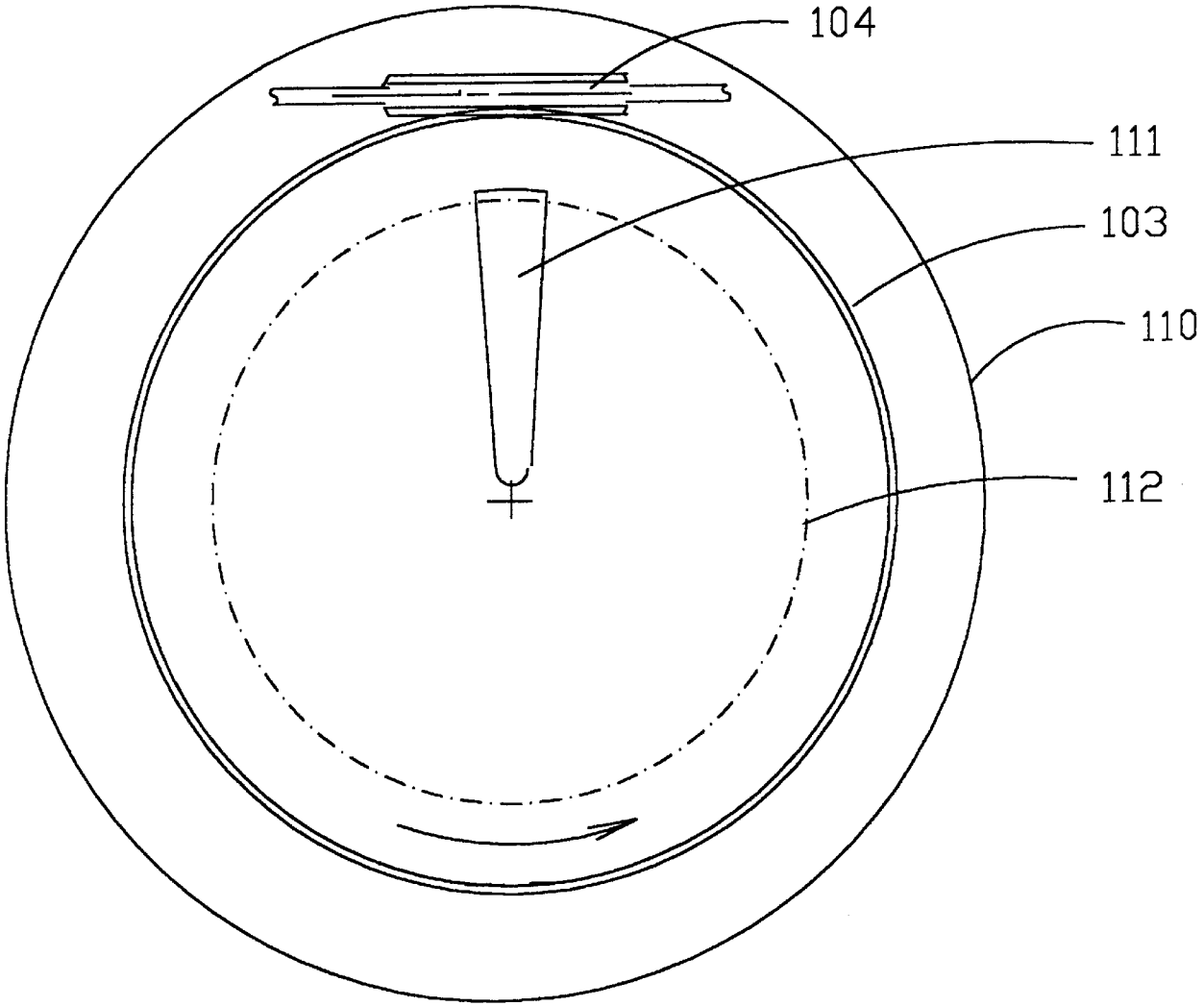
FIG. 9*a* is a cross sectional view of a rotary valve with a cutout so that the flow of exhaust gas passes through the aperture to the porous tubular through flow passageways to remove the layer of soot and/or ash accumulation for the embodiment illustrated in FIG. 9.

In summary, exhaust gas passes into entry chamber (102) and into the through flow passageways containing porous walls. Most of the through flow passageways are blocked by the rotary valve (103) and the exhaust gas is forced to flow through the porous walls where it is filtered and passed in cross flow manner to the exhaust stack and into the atmosphere. The exhaust gas entering the through flow passageways which are not blocked by the rotary valve (103) are blown through at a reasonably high velocity thus dislodging accumulated soot and/or ash. The soot and/or ash particles that are dislodged are blown through a clearance into the separation chamber (105) whereby the soot and/or ash falls down by gravity and settle into the lower portion of the separation chamber (105). The soot and/or ash falling to the bottom of the separation chamber contacts an igniter (113) which ignites any soot. Ash does not ignite but rather accumulates at the bottom of the separation chamber (105). A cap (109) is removed to access the soot and/or ash residue at the bottom of the separation chamber (105) for removal. Any soot and/or ash that does not settle to the bottom of the separation chamber (105) flows with the very low velocity exhaust gas toward the secondary filter (106) whereby the soot and/or ash is filtered allowing the exhaust gas to pass through to passageway (108) and into the exhaust stack and released into the atmosphere. After prolonged periods of use, soot and/or ash may eventually accumulate on the inner surface of the secondary filter (106). To regenerate the secondary filter (106) an electromagnetically energized three-way rotary valve (114) is incorporated as shown in FIG. 9. Normally the valve (114) is aligned with passage (108) allowing the exhaust gas to pass to the exhaust stack and into the atmosphere. However, during regeneration of the secondary filter, the valve (114) is rotated counterclockwise 90 degrees for a short period of time allowing internal passageways (114*a*) of valve (114) to align with a high pressure passageway (116). The high pressure passageway (116) is connected to a high pressure air supply source such as the air brake supply. When valve (114) is aligned with high pressure passageway (116) a small amount of high air pressure is allowed to flow back through the annular filter (106) blowing out any accumulated soot and/or ash. This soot and/or ash is blown into the separation chamber (105) and settles down onto the igniter (113). Once again, any soot settling on the igniter (113) ignites and burns. It should be noted that the normal filtration of all the exhaust gas continues without interruption while the reverse cleaning of the secondary filter (106) is taking place. FIG. 9*a* is a sectional view of the rotary valve (103) showing an aperture (111) that permits exhaust gas to flow through some of the through flow passageways into the separation chamber (105). The flow of exhaust gas is at a sufficient velocity to erode the soot and/or ash buildup; hence, regenerating the through flow passageways. The worm gear (104) drives the rotary valve (103). The aperture (111) in the rotary valve (103) is shown. Further, the diameter (112) of the single particulate trap module is shown by phantom lines.

The method comprises the steps of: permitting the exhaust gas to enter a designated number of through flow passageways with porous walls at sufficient velocity to erode and/or dislodge the layer of soot and/or ash buildup; blocking a plurality of through flow passageways thereby facilitating the build up of exhaust gas pressure to the through flow passageways. Most of the exhaust gas entering the through flow passageways is passed through the porous walls filtering out the soot and/or ash prior to being released into the atmosphere; unblocking a plurality of subsequent through flow passageways containing porous walls periodically thereby allowing exhaust gas into the through flow passageways to erode and/or dislodge the accumulated layer of soot and/or ash from the inner surface of the through flow passageways as previously explained. The eroded and/or dislodged soot and/or ash is separated by the separation chamber. The separated soot is burned by a burner and stored with the ash for removal. The exhaust gas not filtered through the through flow passageways is filtered through a secondary filter prior to being released into the atmosphere.

Figure 9B:
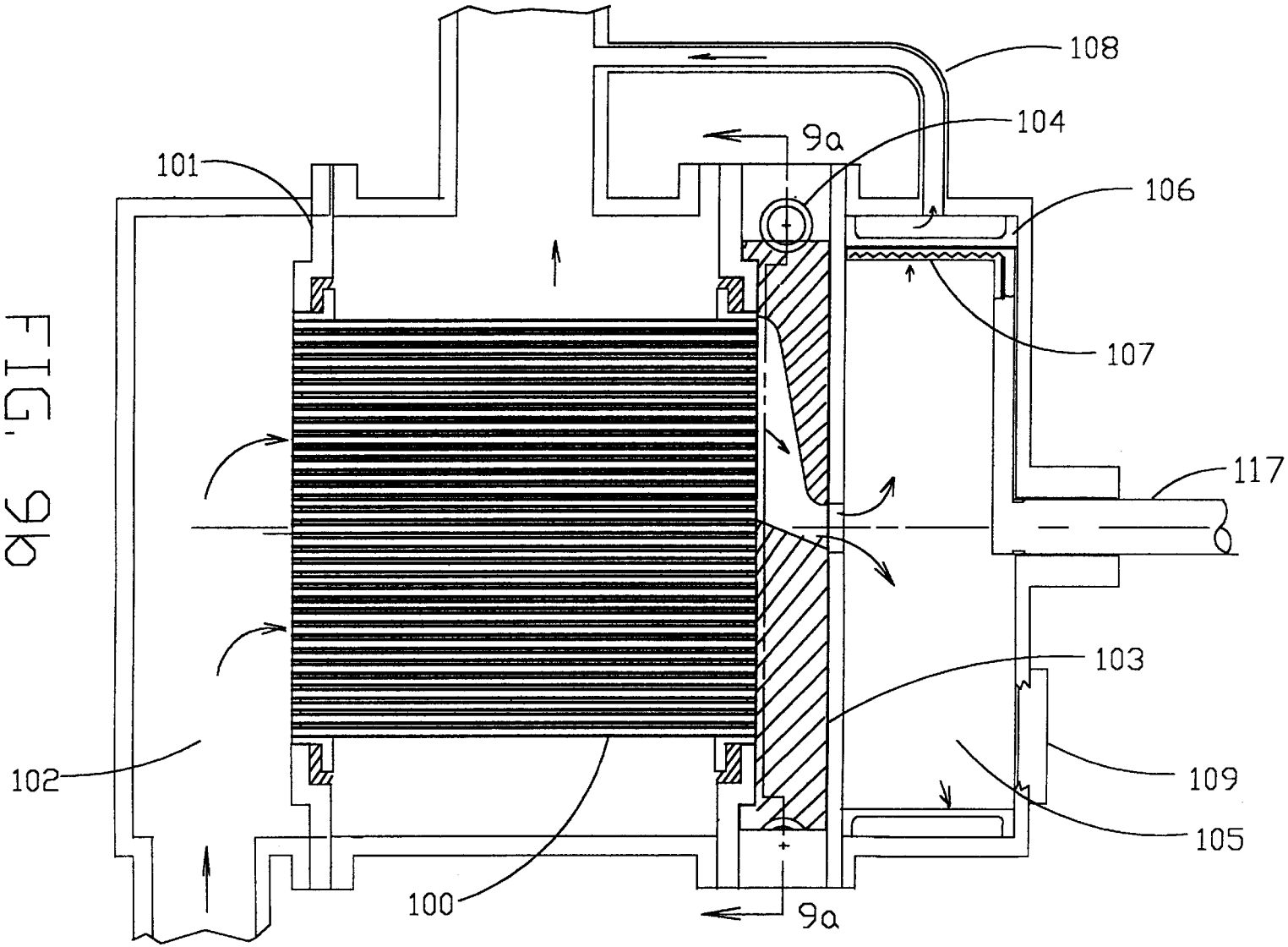
FIG. 9*b* is a sectional view of a second alternative embodiment of a particulate trap system with a single particulate trap module incorporating an electrically energized rotary heater and scraper driven by a shaft to remove the layer of soot and/or ash accumulation on the secondary filter.

FIG. 9*b* is an alternative embodiment of the arrangement shown in FIG. 9. It is the same in all respects except there is means for periodically cleaning the secondary filter (106) and the use of high pressure air for reverse flow cleaning is eliminated along with the associated electromagnetically actuated three-way valve (114). Instead, an electrically energized rotary heater and scraper (107) driven by a shaft (117) in a small drive motor (not shown) are used to remove the soot and/or ash accumulating on the secondary filter (106) whereby the heater and scraper (107) are heated electrically through a circuit and slip rings (not shown) on shaft (117).

In operation, the heater and scraper (107) are heated to a high temperature and slowly rotated about the inner surface of the secondary filter (106) wherein it heats and burns any collected soot and mechanically dislodges any ash accumulation. The soot and/or ash dislodged or soot burned by the heater and scraper (107) settles at the bottom of the separation chamber (105). Residue ash and any unburned soot is removed by removing cap (109).

Figure 9C:
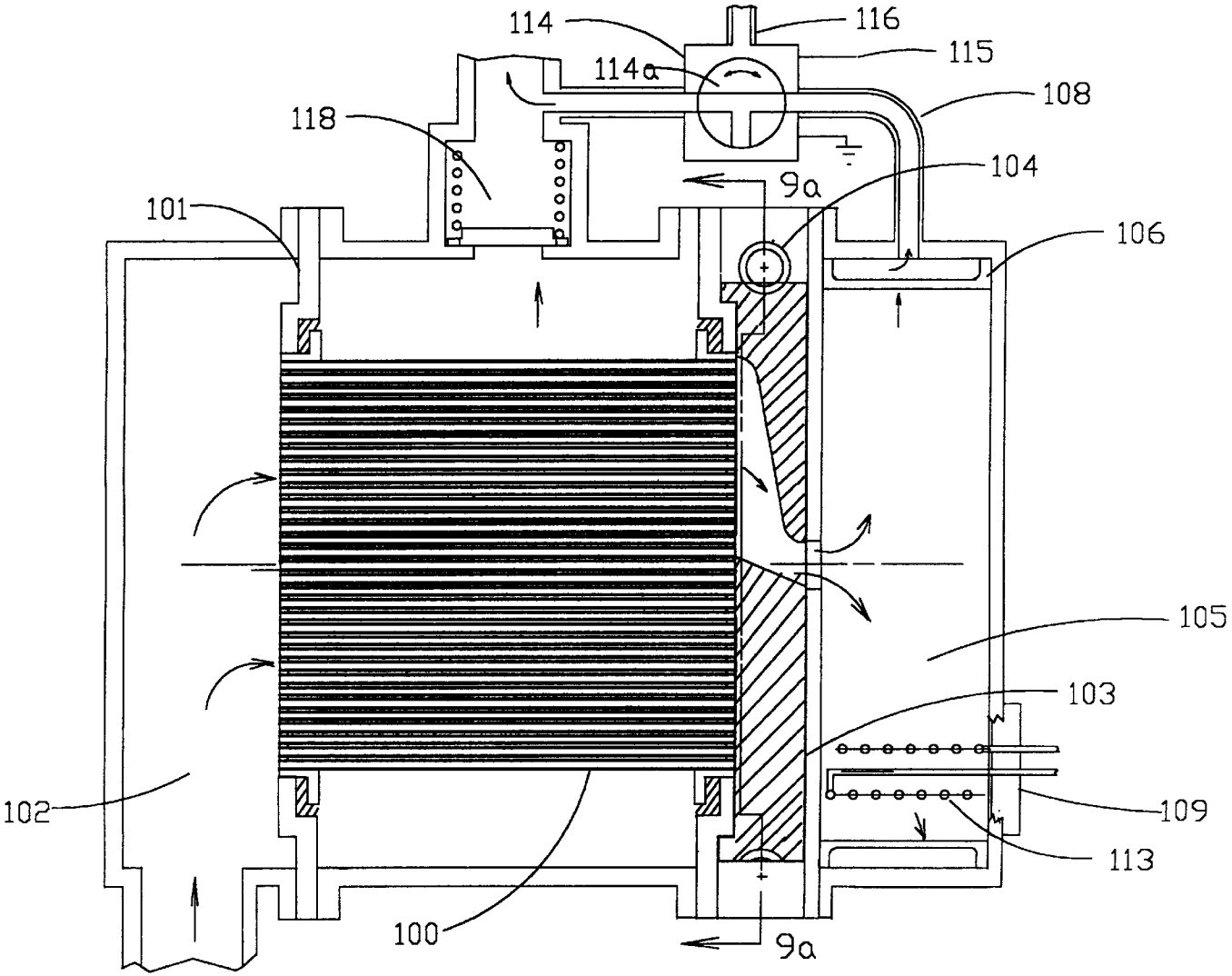
FIG. 9*c* is a sectional view of a third alternative embodiment of a single particulate trap module incorporating a pressure relief valve.

FIG. 9*c* is an alternative embodiment and the same in all respects as that in FIGS. 9 and 9*b* except that a pressure relief valve (118) is incorporated after the single cross flow particulate trap (100) and before the exhaust stack. In some applications wherein the engine may spend long periods of time at low idle with very low total exhaust flow, the velocity through the unblocked or uncovered through flow passageways undergoing regeneration may not be sufficient to totally dislodge all of the accumulated soot and/or ash. The pressure relief valve (118), while adding minimal restriction to the exhaust gas flow from the porous through flow passageways at high loads will significantly increase the exhaust gas velocity through the unblocked though flow passageways undergoing regeneration. The pressure relief valve (118) will prohibit exhaust gas flow from flowing into the exhaust stack until a sufficient pressure is achieved. This is beneficial, especially at low idle, because the exhaust gas velocity will be increased through the through flow passageways due to the pressure relief valve; hence, improving regeneration during low idle.

Figure 10:
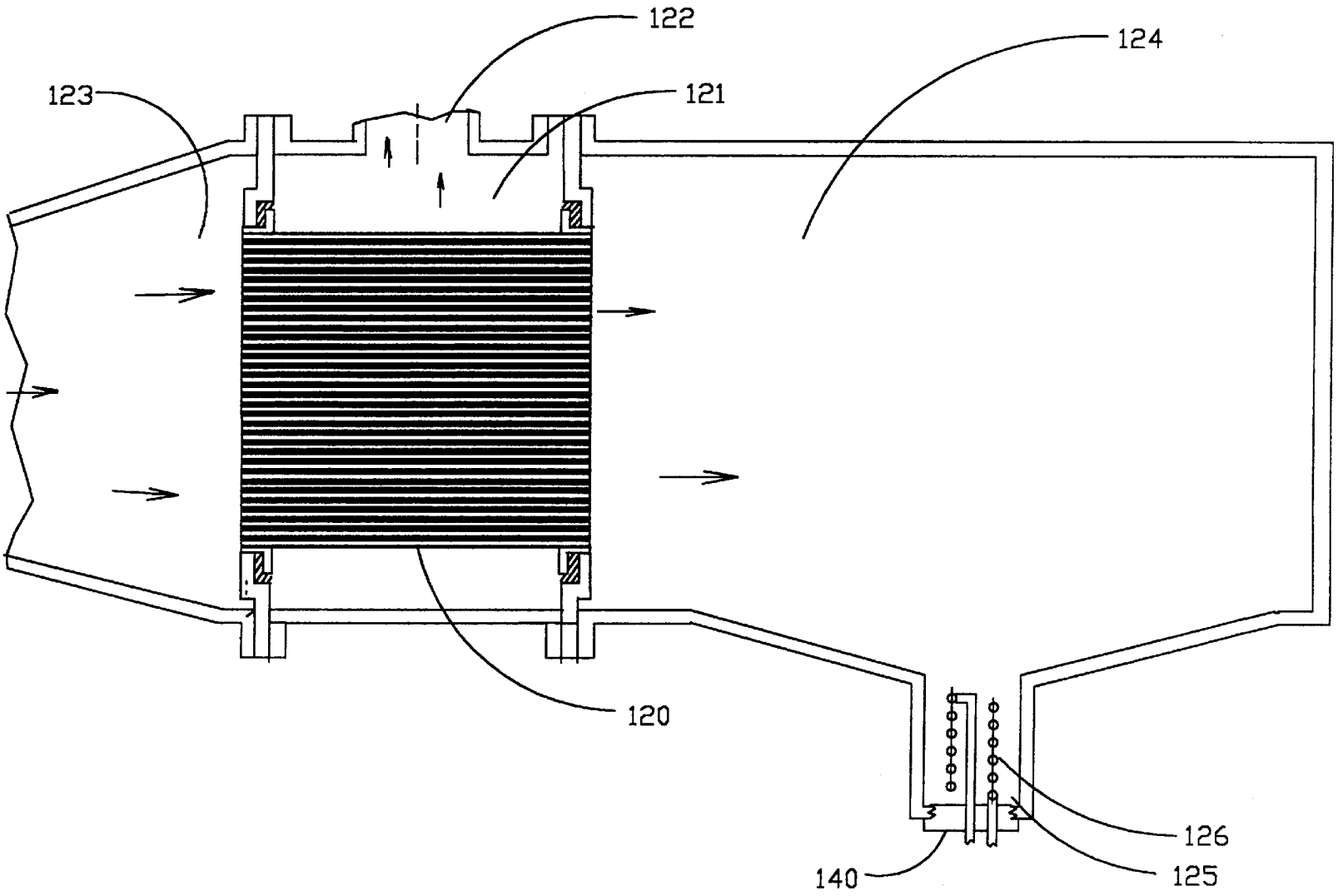
FIG. 10 is a sectional view of a single cross flow particulate trap module with porous tubular through flow passageways placed in an exhaust duct of a diesel or other internal combustion engine in which regeneration is effected by the through flow from the engine exhaust pulses.
Figure 11:
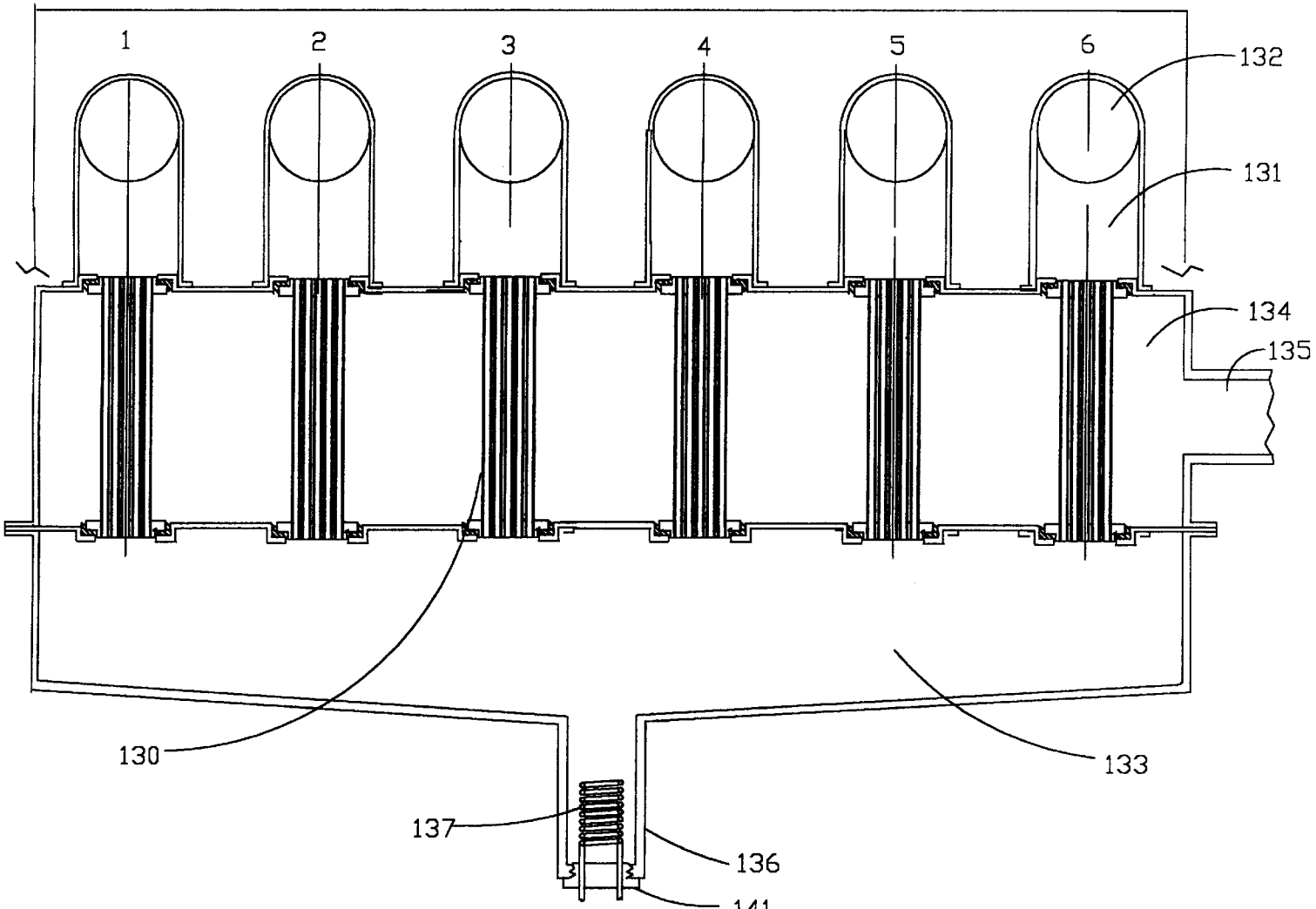
FIG. 11 is a sectional view of an embodiment that incorporates a plurality of cross flow particulate trap modules in which regeneration of the porous tubular through flow passageways are effected by through flow from the engine exhaust pulses wherein periodic flow of the exhaust gas emanates from the individual exhaust ports.
Figure 12:
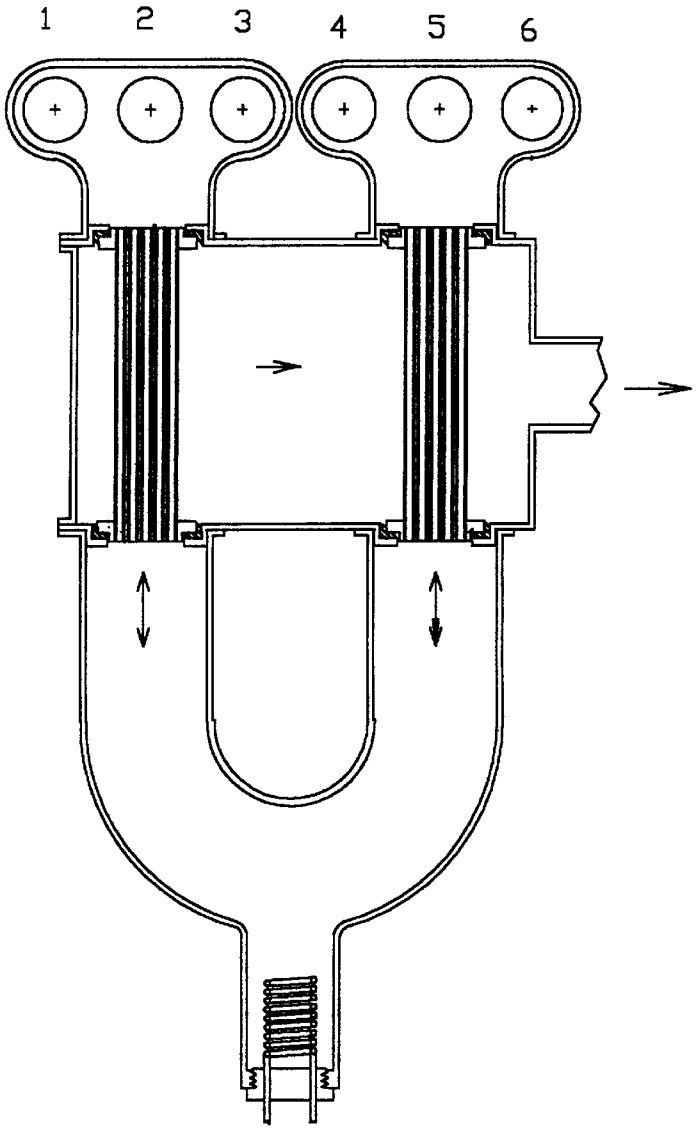
FIG. 12 is an embodiment that incorporates a particulate trap module for multiple exhaust ports wherein the particulate trap module is connected to the manifold of a group of cylinders.
Figure 4A:
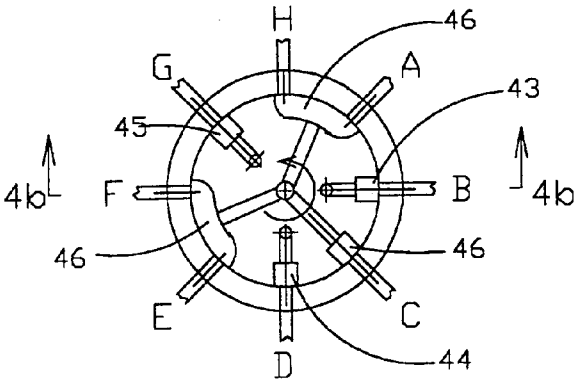
Figure 4B:
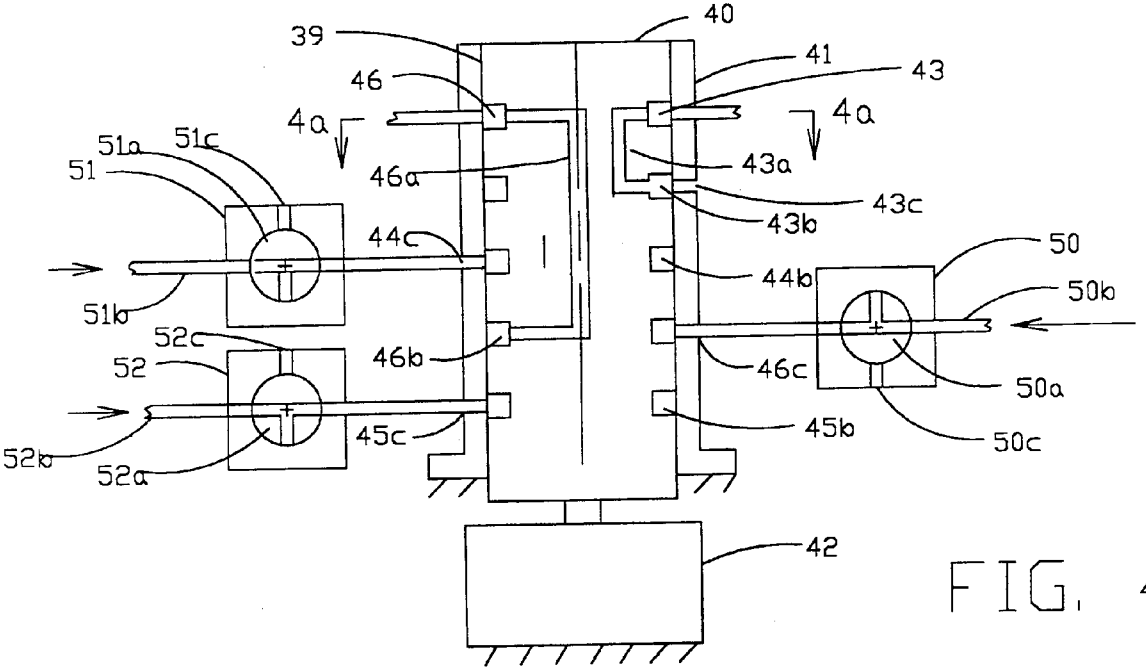

FIGS. 10, 11 and 12 show embodiments that utilize the intermittent or pulse flow of exhaust gas that is inherent in most internal combustion engines to erode and/or dislodge the soot and/or ash on the walls of the through flow passageways and to filter particulate from the exhaust gas.

The embodiment shown in FIG. 10 illustrates a single cross flow particulate trap module (120) comprising tubular through flow passageways that are open on each end. The through flow passageways have porous walls for filtering out soot and/or ash from the exhaust gas. Exhaust gas is passed from the engine into the through flow passageways of the single cross flow particulate trap module (120). Some of the exhaust gas under pressure is filtered by being passed through the porous walls. This filtered gas exits through the clearance gaps surrounding the through flow passageways and enters a clean gas chamber (121) and passes to exhaust duct (122) into the atmosphere. This type of single cross flow particulate trap module which is composed of at least one tubular through flow passageway is similar in principle of operation to other embodiments previously described and illustrated and no detailed discussion is considered necessary.

The single cross flow particulate trap module (120) is attached to a duct (123) that is connected to the exhaust manifold of the engine (not shown). The opposite end of the particulate trap module (120) is attached to a surge duct (124) which has no outlet. An ash collection chamber (125) contains a high temperature ignition coil (126) which is located in the surge duct (124).

In operation, an acceptable average back pressure to the engine is approximately 25 inches $H_2O$. This exists in duct (123) and surge duct (124). Under the influence of this pressure, exhaust gas is continually flowed through the porous walls of the tubular through flow passageways that are contained in the single cross flow particulate trap module (120). The exhaust gas is filtered by passing it through the porous walls. This filtered gas is passed to the clearance gap surrounding the through flow passageways into the clean gas chamber (121) and into exhaust duct (122) which releases the filtered exhaust gas into the atmosphere. This filtering action results in a deposit layer of soot and/or ash accumulating on the inside surface of the porous walls which increases engine back pressure; hence, must be removed to avoid engine performance problems. Regeneration is a method used to erode or dislodge the soot and/or ash layer from the porous walls.

In conventional reciprocating internal combustion engines, the exhaust gas leaves the cylinders in intermittent or pulse pressure surges. In four stroke engines these surges are due to the blow down process that occurs when each exhaust valve opens followed by the pistons forcing the exhaust out on the exhaust stroke. In the case of two stroke engines, a similar blow down process occurs when the exhaust ports or exhaust valves open and this is followed by the scavenging.

In this embodiment, the single cross flow particulate trap module (121) is located relatively close to the engine thus minimizing the volume contained in duct (123). The intermittent flow from the engine results in a pressure pulse in duct (123) that is significantly higher in pressure than the average pressure that exists in surge duct (124). This pulse causes a strong flow through the porous tubular through flow passageways in the single cross flow particulate trap module (120). This flow regenerates the single cross flow particulate trap module (120) and the exhaust gas with soot and/or ash empties into surge chamber (124), temporarily increasing the pressure in surge chamber (124) above the average value. Once again, the pulses of exhaust gas create brief high velocity flow that erodes and/or dislodges any substantial accumulation of soot and/or ash and blows it into the surge chamber (124). In the time interval between pulses, the higher pressure in surge duct (124) causes exhaust gas to flow back into the tubular through flow passageways where the exhaust gas is filtered through the porous walls into the clearance gaps and into the clean gas chamber (121) and into duct (122) where it is released into the atmosphere as cleaned exhaust gas.

Because there is zero average flow in the surge duct (124), the relatively large dislodged particles of soot and/or ash drop by the influence of gravity and collects in the ash collection chamber (125). Soot ignites when it contacts the high temperature ignition coil (126) resulting in ash. Ash, which is incombustible, collects in the ash collection chamber (125) for periodic removal. Access to the ash is accomplished by unscrewing cap (140). For this and all the other embodiments, various devices can be used to allow access to the accumulated ash, such as, doors, trays, plugs and other similar devices.

While this embodiment may be used on any internal combustion engine, it is best suited for four stroke, naturally aspirated, low or lightly turbocharged engines with few cylinders (6 or less) exhausting into a given particulate trap module and least suited for highly turbocharged engines because the exhaust turbine absorbs much of the intermittent flow or pulse in the exhaust.

FIG. 11 is a first alternative embodiment of FIG. 10 that operates on the same principle. However, in FIG. 10, there are a plurality of cross flow particulate trap modules (130) which contain a plurality of porous tubular through flow passageways wherein the particulate trap modules (130) are connected at one end directly to passages (131) that extend from ports (132) from individual engine exhaust valves (not shown). The exit ends of each particulate trap module (130) are connected to surge chamber (133) that has no other outlets.

In operation, an average pressure exists in the passages (131) and in surge chamber (133). This average pressure causes exhaust gas to flow through the porous walls of the through flow passageways of the particulate trap modules (130). As in the other arrangements previously shown and discussed herein, some of the exhaust gas is filtered through the porous walls of the tubular through flow passageways and exits in a cross flow manner through the clearance gaps surrounding the through flow passageways into a clean gas chamber (134) and then into exit duct (135) which passes the filtered gas into the atmosphere. As previously discussed, this results in a build up of soot and/or ash on the inner surface of the through flow passageways that must be removed to prevent an increase in pressure drop across the trap and an increase in engine back pressure that would adversely affect engine performance. The processes to remove the soot and/or ash build up is called regeneration.

When the exhaust valve of any of the engine cylinders (1–6 is shown but this embodiment can encompass less or more engine cylinders) opens, a fast flow of exhaust gas occurs through the passages (131). To illustrate the regeneration process, we will assume that exhaust valve (5) opens. As exhaust valve (5) opens, the high velocity flow of exhaust gas coupled with the relatively small volume of the passages (131) causes a high flow to occur through the connected particulate trap module (130) which erodes and/or dislodges any substantial deposits of soot and/or ash and carries them into the surge chamber (133). The surge chamber (133) volume at this instance consists of both its main volume and the volume of the other particulate traps (133) and its passages (131). Thus, the surge of exhaust gas out of cylinder 5 that is not filtered through the porous walls on the initial pass through the through flow passageways passes into the surge chamber (133) increasing pressure which causes exhaust in the surge chamber (133) to flow back into all of the remaining particulate trap modules (130) wherein the gas is filtered by flowing through the porous walls. This same action is carried out for each of the other particulate trap modules (130) connected with the other engine cylinders, in turn. Obviously, exhaust gas will not flow back into a particulate trap module which is receiving pressure from the engine.

In summary, the flow of exhaust gas is filtered in two ways. First, on the initial pass through the through flow passageways, some exhaust gas is filtered. Secondly, exhaust gas passing to the surge chamber (133) returns through the through flow passageways in between the pulses of the engine and is filtered through the porous walls of the through flow passageways.

Because there is zero net flow in the surge chamber (133) and the frequency of valve opening is quite high, gravity causes the relatively large particles of soot and/or ash to settle to the bottom and eventually catch in a soot and ash receptacle (136). Any soot coming in contact with a high temperature coil (137) is ignited and burned. Ash settles in the soot and ash receptacle (136) where it is removed periodically. Access to the ash is accomplished by unscrewing cap (141). For this and all the other embodiments, various devices can be used to allow access to the accumulated ash, such as, doors, trays, plugs and other similar devices.

This type of embodiment is a pulse regenerated design and as with all of the pulse regenerated designs previously illustrated there is an advantage of simplicity because there are no moving parts or controls required. In addition, because of the close proximity to the engine some of the soot in the through flow passageways is burned by the heat of the engine exhaust. As has been previously discussed with other embodiments, the exhaust gas flow is used to regenerate the particulate trap modules (130). The ignition of the soot by the exhaust gas does not result in a decreased life of the traps (130) because very little soot is allowed to accumulate even under low loads and cool operation and the heat generated by combustion of collected soot is carried out of the particulate trap modules (130) frequently.

Another advantage of this embodiment is that a number of particulate trap modules (130) are used, thus each is substantially small in dimensions relative to the single trap modules. This enhances the possibility of placing the particulate trap modules (130) very close to the engine and is less expensive to manufacture.

FIG. 12 is a second alternative embodiment of FIGS. 10 and 11 and also uses a pulse flow to regenerate the particulate trap modules. This embodiment is very similar to FIG. 11; however, more than one exhaust valve is configured or connected to one particulate trap module. In the illustration for FIG. 12, one particulate trap module is connected to the front manifold and one is connected to the rear manifold. In a six cylinder in-line engine the pulses alternate between the front and rear manifolds. The regeneration and filtering process is consistent with the description for FIG. 11. FIG. 12 simply illustrates one of a large number of arrangements that are possible and because the operation is essentially the same, no further discussion is considered necessary.

In all the embodiments previously described and illustrated, it is foreseeable that some soot and/or ash will remain in the through flow passageways after regeneration under certain engine operating conditions (for example, i.e., under idle conditions, very cold weather, etc.). Although most soot and/or ash is eroded and/or dislodged from the particulate trap modules even under severe engine operating conditions, some small amount could build up on the wall surface of the through flow passageways causing excessive pressure drop across the particulate trap module and back pressure being applied to the engine. To reduce this risk and in the process reduce hydrocarbon emissions, a catalyst coating on the inside of the through flow passageways could be used. This causes the deposited hydrocarbons to burn at lower temperatures than would otherwise result. The heat thus imparted to the particulate trap modules assists the through flow gas to erode the soot and/or ash deposits. Catalyst for this type of application is well-known and widely used in engine systems. The catalyst coating could be effectively used with any of the embodiments that were previously discussed and illustrated. Further, a catalyst could be added to the fuel.

While a preferred embodiment of the invention has herein been illustrated and described, this has been done by way of illustration and not limitation, and the invention should not be limited except as required by the scope of the appended claims.

We claim:

1. A particulate trap system for an internal combustion engine, comprising:

at least one cross flow particulate trap module positioned to accept engine exhaust gas and having a plurality of through flow passageways for receiving a flow of exhaust gas and having porous walls through which the exhaust gas passes for filtering particulate from the exhaust gas; and means for periodically controlling the flow of the exhaust gas at a sufficient velocity in the through flow passageways to erode and dislodge any build-up of particulate.

2. The particulate trap system in claim 1, wherein there are a plurality of particulate trap modules having a plurality of through flow passageways for receiving the flow of exhaust gas in two directions and having porous walls through which the exhaust gas passes for filtering particulate from the exhaust gas.

3. The particulate trap system in claim 2, wherein the means for controlling the flow, comprises;

a plurality of valves wherein at least one valve blocks an entrance end of the through flow passageways of the particulate trap module and at least one valve which is periodically pulled away from the entrance end of the through flow passageways of another particulate trap module periodically allowing exhaust gas to flow through the through flow passageways for filtering and at a sufficient velocity to erode and dislodge any build-up of particulate.

4. The particulate trap system in claim 3, wherein the valves are pulled away from the entrance end of the through flow passageways in response to a pre-established engine operating condition.

5. The particulate trap system in claim 4, wherein the pre-established engine operating condition is based on load.

6. The particulate trap system in claim 4, wherein the pre-established engine operating condition is based on speed.

7. The particulate trap system in claim 3, wherein the valves are pneumatically actuated.

8. The particulate trap system in claim 7, further comprising:

means for controlling the flow of air to the pneumatically actuated valves.

9. The particulate trap system in claim 8, wherein the means for controlling the flow of air to the pneumatically actuated valves, comprises:

a rotary valve member fitted into a cylinder with a tight clearance used to control the flow of air;

a pocket register connected to passages which vents off any supplied air thereby allowing at least one pneumatically actuated valve to open;

connecting pocket registers containing passages that connects with air tubes used for carrying air from the passages to a plurality of pneumatically actuated valves wherein the air forces a plurality of actuator pistons to compress and overcome a plurality of springs closing the plurality of pneumatically actuated valves; and wherein the air tubes contain a three way valve used to assure that the plurality of pneumatically controlled valves are pressurized;

means to periodically rotate the rotary valve member to change the previously opened pneumatically actuated valve to a closed position and to change at least one previously closed pneumatically activated valve to opened in a sequential order to regenerate one particulate trap module; and means to allow access to the soot and/or ash accumulation for removal.

10. The particulate trap system in claim 9, wherein the pocket registers are connected to the passages and vent off any supplied air to the plurality of pneumatically actuated valves to simultaneously hold open the plurality of pneumatically actuated valves for regeneration of the plurality of traps.

11. The particulate trap system in claim 7, wherein air pressure is supplied to the pneumatically actuated valves by an air brake supply.

12. The particulate trap system in claim 7, wherein the valves further comprise:

an actuator;

a cylinder that is the inner surface of the actuator;

an actuator piston extending across the cylinder;

an air tube pneumatically connected with the cylinder to transfer air from the air tube to the cylinder, and wherein the air builds up in the cylinder causing the actuator piston to move away from the air tube;

a spring connected with opposite side of the actuator piston wherein the spring resists movement away from the air tube;

a member connected with the actuator piston; and a valve connected with member wherein the valve is forced closed when the air pressure overcomes the force of the spring, and wherein the valve is forced opened by the spring when the spring force overcomes the air pressure.

13. The particulate trap system in claim 7, wherein the valves further comprise:

high temperature bellows; and seat areas for the bellows to contact when the valve is in the closed position.

14. The particulate trap system in claim 13, wherein the valves further comprise:

a plate attached to the high temperature bellows; and seat areas for the plate to contact when the valve is in the closed position.

15. The particulate trap system in claim 1, further comprising:

clearance gaps surrounding the through flow passageways wherein the exhaust gas that passed through the porous walls during filtering is released;

a collection chamber wherein the filtered exhaust gas from the clearance gaps flows; and an exhaust stack that channels the filtered exhaust gas from the collection chamber to the atmosphere.

16. The particulate trap system in claim 1, further comprising:

a plurality of partitions arranged to seal and mount the particulate trap modules; and a seal that is mounted between the partition and particulate trap module.

17. The particulate trap system in claim 1, further comprising:

a heater to heat the incoming exhaust gas to facilitate the erosion and dislodging of soot and/or ash from the through flow passageway.

18. The particulate trap system in claim 1, further comprising:

a burner to heat the incoming exhaust gas to facilitate the erosion and dislodging of soot and/or ash from the through flow passageway;

a nozzle to inject fuel in a fine mist with the oxygen rich exhaust gas flow; and means to ignite the fuel.

19. The particulate trap system in claim 1, further comprising:

an electrical heater to heat the incoming exhaust gas in the particulate trap system to facilitate the erosion and dislodging of soot and/or ash from the through flow passage way.

20. The particulate trap system in claim 1, wherein the means for controlling the flow, comprises:

a rotary valve plate;

means for rotating the rotary valve plate around the single cross flow particulate trap blocking off the flow of exhaust gas into a plurality of through flow passageways; and wherein the rotary valve plate has an aperture to allow the flow of exhaust gas into a plurality of through flow passageways for filtering and at a sufficient velocity to erode and dislodge any accumulation of particulate.

21. The particulate trap system in claim 20, further comprising:

an entrance chamber for receiving the exhaust gas from the engine and passing the exhaust gas through the aperture on the rotary valve plate into to through flow passageways for filtering and eroding and dislodging any soot and/or ash accumulation and wherein the rotary valve plate is mounted on the entrance chamber side of the particulate trap module;

a distribution chamber for receiving the exhaust gas from the though flow passageways and having louvers for separating soot and/or ash from the exhaust flow;

a separation chamber wherein the separated soot and/or ash settles in the bottom of the separation chamber;

an igniter coil mounted on the bottom of the separation chamber to ignite soot on contact;

means to allow access to the soot and/or ash accumulation for removal; and wherein the distribution chamber directs the flow of exhaust gas exiting the through flow passageways into the unblocked ends of the blocked through flow passageways for filtering and wherein the filtered exhaust gas is passed through the porous walls of the blocked through flow passageways into the atmosphere.

22. The particulate trap system in claim 21, further comprising:

a pressure relief valve for relieving pressure in the entrance chamber when a pressure limit is exceeded and wherein the gas is passed into the separation chamber from the pressure relief valve.

23. The particulate trap system in claim 22, further comprising:

a heater located after the pressure relief valve and before the particulate trap modules to heat the incoming exhaust gas to facilitate the erosion and dislodging of soot and/or ash from the through flow passage ways.

24. The particulate trap system in claim 22, further comprising:

a burner located after the entrance of the pressure relief valve and before the particulate trap modules to heat the incoming exhaust gas to facilitate the erosion and dislodging of soot and/or ash from the through flow passageway;

a nozzle to inject fuel in a fine mist with the oxygen rich exhaust gas flow; and means to ignite the fuel.

25. The particulate trap system in claim 22, further comprising:

an electrical heater located after the pressure relief valve and before the particulate trap modules to heat the incoming exhaust gas to facilitate the erosion and dislodging of soot and/or ash from the through flow passage way.

26. The particulate trap system in claim 20, further comprising:

an entrance chamber for receiving the exhaust gas from the engine and passing the exhaust gas into the unblocked ends of the blocked through flow passageways for filtering and into and through the unblocked through flow passageways for filtering, and eroding and dislodging any particulate accumulation and wherein the rotary valve plate is mounted on the end of the particulate trap module which is opposite the entrance chamber side of the particulate trap module;

a separation chamber for receiving the exhaust gas from the though flow passageways for separating particulate from the exhaust flow;

a second filter for filtering the exhaust gas entering the separation chamber;

an igniter coil mounted on the bottom of the separation chamber to ignite soot on contact; and means to allow access to the ash accumulation for removal.

27. The particulate trap system in claim 1, wherein the means for controlling the flow, comprises:

a rotary valve;

means for rotating the rotary valve around a single cross flow particulate trap module blocking off the flow of exhaust gas from exiting a plurality of through flow passageways wherein the blocked through flow passageways are used to filter particulate from the exhaust gas; and wherein the rotary valve has an aperture to allow the flow of exhaust gas through a plurality of through flow passageways for filtering and at a sufficient velocity to erode and dislodge any accumulation of particulate.

28. The particulate trap system in claim 27, further comprising:

an entry chamber for receiving the exhaust gas from the engine and through flow passageways for filtering particulate;

wherein the rotary valve is mounted at the exit end of the through flow passageways;

a separation chamber for receiving the exhaust gas from the unblocked through flow passageways and for separating particulate from the exhaust flow;

an igniter mounted on the bottom of the separation chamber to ignite soot on contact;

means for allowing access to the soot and/or ash accumulation for removal;

wherein the rotary valve directs the flow of exhaust gas exiting the through flow passageways into the settling chamber which is equipped with a secondary filter for filtering and wherein the filtered exhaust gas is passed through a passage into the atmosphere;

an electromagnetically energized three-way rotary valve for which is connected to a high pressure source for supplying a burst of high pressure air to the secondary filter in reverse flow to dislodge any soot and/or ash accumulation;

wherein the passageway used to pass filtered exhaust gas to atmosphere is used for supplying the burst of high pressure air to the secondary filter; and wherein the electromagnetically energized three-way rotary valve is rotated to align the high pressure passageway with the passage to allow air to the secondary filter.

29. The particulate trap system in claim 27, further comprising:

an entry chamber for receiving the exhaust gas from the engine and through flow passageways for filtering any particulate;

wherein the rotary valve is mounted at the exit end of the through flow passageways;

a separation chamber for receiving the exhaust gas from the unblocked though flow passageways and for separating particulate from the exhaust flow;

an igniter mounted on the bottom of the separation chamber to ignite soot on contact;

means to allow access to the soot and/or ash accumulation for removal;

wherein the rotary valve directs the flow of exhaust gas exiting the through flow passageways into the settling chamber which is equipped with an annular porous ceramic secondary filter for filtering and wherein the filtered exhaust gas is passed through a passage into the atmosphere; and a heater and scraper that is heated and slowly rotated about the inner surface of the annular filter and wherein the heater and scraper burns off the soot and dislodges the ash.

30. The particulate trap system in claim 1, wherein the means for controlling the flow of exhaust gas to dislodge soot and/or ash is the intermittent engine gas surges.

31. The particulate trap system in claim 30, wherein the means for regenerating the particulate trap module, further comprises:

a duct connecting the exhaust manifold to the particulate trap module and wherein the exhaust manifold transfers pressure surges from the engine cylinders to the particulate trap module;

wherein the surges of exhaust gas flow are at sufficient velocity to erode and dislodge most soot and/or ash in the particulate trap module;

a surge duct connected to the exit end of the particulate trap module to accumulate the surge flow of exhaust gas and to separate the soot and ash from the exhaust gas;

wherein the surge duct allows exhaust gas pressure to build and flow back into the through flow passageways in between pulses for filtering through the porous walls;

a clean gas chamber that receives the filtered exhaust gas from the porous walls;

an exhaust duct connected to the clean gas chamber for releasing the filtered exhaust gas into the atmosphere;

an ignition coil for igniting any soot that settles in the surge duct; and means for allowing access to the soot and/or ash accumulation for removal.

32. The particulate trap system in claim 30, wherein the means for regenerating the particulate trap modules, further comprises:

ports connected to individual engine exhaust valves;

passages connecting to the ports at one end and to the cross flow particulate trap modules at the other end;

wherein when the exhaust valves open releasing a surge of exhaust gas at high velocity through the particulate trap modules for filtering and regenerating the particulate trap modules receiving the surge of exhaust flow;

a surge chamber connected to the exit end of the particulate trap modules for separating the soot and ash from the regeneration and surge exhaust gas;

wherein the surge chamber allows exhaust gas pressure to build and flow back into the through flow passageways not receiving the exhaust gas flow in between pulses for filtering through the porous walls;

a clean gas chamber that receives the filtered exhaust gas from the porous walls;

an exit duct connected to the clean gas chamber for releasing the filtered exhaust gas into the atmosphere;

a high temperature coil for igniting any soot that settles in the surge duct; and means for allowing access to the soot and/or ash accumulation for removal.

33. The particulate trap system in claim 30, wherein the means for regenerating the particulate trap modules, further comprises:

ports connected to a plurality of engine exhaust valves;

passages connected to the ports at one end and to the cross flow particulate trap modules at the other end;

wherein when the exhaust valves open releasing a surge of exhaust gas at high velocity, the particulate trap modules are regenerated;

a surge chamber connected to the exit end of the particulate trap modules for separating the soot and ash to accept the surge of exhaust gas;

wherein the surge chamber allows exhaust gas pressure to build and flow back into the through flow passageways not receiving the flow of exhaust gas in between pulses for filtering through the porous walls;

a clean gas chamber that receives the filtered exhaust gas from the porous walls;

an exit duct connected to the clean gas chamber for releasing the filter exhaust gas into the atmosphere;

a high temperature coil for igniting any soot that settles in the surge duct; and means for allowing access to the soot and/or ash accumulation for removal.

34. The particulate trap system in claim 1, further comprising:

a catalyst coated on the inner surface of the through flow passageways to facilitate the regeneration process.

35. The particulate trap system in claim 1, wherein the exhaust gas is passed out of the through flow passageways and back into the through flow passageways in the opposite direction for filtering.

36. The particulate trap system in claim 1, further comprising:

a secondary filter for filtering particulate from exhaust gas, and wherein the exhaust gas passing out of the through flow passageways is passed through the secondary filter for filtering.

37. A particulate trap system for an internal combustion engine, comprising:

a plurality of particulate trap modules positioned to accept engine exhaust gas having a plurality of through flow passageways for receiving the flow of exhaust gas in two directions and having porous walls through which the exhaust gas passes for filtering particulate from the exhaust gas;

means for periodically controlling the flow of the exhaust gas at a sufficient velocity in the through flow passageways to erode and dislodge any build-up of particulate, wherein the means for periodically controlling the flow includes a plurality of valves wherein at least one valve blocks an entrance end of the through flow passageways of the particulate trap module and at least one valve which is periodically pulled away from the entrance end of the through flow passageways of another particulate trap module periodically allowing exhaust gas to flow through the through flow passageways for filtering and at a sufficient velocity to erode and dislodge any build-up of particulate;

an entrance port for receiving the exhaust gas from the engine;

a valve chamber containing the valves and wherein the exhaust gas is passed from an entrance port to the valve chamber;

a separation plate containing louvers located at the exit end of the through flow passageways for separating particulate from the exhaust gas;

a separation chamber wherein the separated particulate is directed and a separation tube connected to the separation chamber for directing the particulate;

an igniter wherein the igniter is located at the bottom of the separation chamber and wherein the particulate from the separation tube is directed and wherein particulate that contacts the igniter ignites and burns;

means to allow access to the soot and/or ash accumulation for removal; and a distribution chamber used for directing the exhaust gas and any particulate not separated by the separation plate and louvers to a subsequent trap for filtering.

38. The particulate trap system in claim 37, further comprising:

a pressure relief valve for relieving pressure in the valve chamber when a pressure limit is exceeded and wherein the exhaust gas is passed into the distribution chamber from the pressure relief valve.

39. The particulate trap system in claim 38, further comprising:

an electrical heater located after the pressure relief valve and before the particulate trap modules to heat the incoming exhaust gas to facilitate the erosion and dislodging of soot and/or ash from the through flow passage way.

40. The particulate trap system in claim 37, further comprising:

a heater located after the pressure relief valve passage and before the particulate trap modules to heat the flow of incoming exhaust gas to facilitate the erosion and dislodging of soot and/or ash from the through flow passageways.

41. The particulate trap system in claim 37, further comprising:

a burner located after the entrance of the pressure relief valve and before the particulate trap modules to heat the incoming exhaust gas to facilitate the erosion and dislodging of soot and/or ash from the through flow passageways;

a nozzle to inject fuel in a fine mist with the oxygen rich exhaust gas flow; and means to ignite the fuel.

42. A method for regenerating a particulate trap module with exhaust gas and for filtering particulate from the exhaust gas, comprising the steps of:

passing the exhaust gas through porous walls of a plurality of though flow passageways of a particulate trap module for filtering; and periodically manipulating the incoming exhaust gas flow through the through flow passageways of the particulate trap module at a velocity sufficient to dislodge and erode particulate accumulation on the porous walls.

43. The method for filtering particulate from exhaust gas and for regenerating particulate trap modules in claim 42, further comprising the steps of:

relieving pressure in the particulate trap system by incorporating a pressure relief valve prior to the particulate trap modules to prevent the build-up of excessive pressure within the particulate trap system.

44. The method for filtering particulate from exhaust gas and for regenerating particulate trap modules in claim 43, further comprising the steps of:

heating the flow of exhaust gas passing through the through flow passageways being regenerated to improve the erosion of soot and/or ash from the through flow passageways.

45. The method for filtering particulate from exhaust gas and for regenerating particulate trap modules in claim 43, further comprising the steps of:

applying catalyst to the particulate trap modules to facilitate the erosion of soot and/or ash from the particulate trap modules.

46. A method for filtering particulate from exhaust gas and for regenerating particulate trap modules, comprising the steps of:

positioning a particulate trap module to accept exhaust gas;

receiving the exhaust gas into a through flow passageways having porous walls, and wherein some of the exhaust gas is filtered through the porous walls and the remaining exhaust gas flow is filtered in a subsequent particulate trap module; and controlling the flow of the exhaust gas at a sufficient velocity in the through flow passageways to erode and dislodge any build-up of particulate.

47. The method for filtering particulate from exhaust gas and for regenerating particulate trap modules in claim 46, further comprising the steps of:

separating the soot and ash from the exhaust gas, and wherein the separated soot and ash is ignited and the ash stored until removal; and directing the filtered exhaust gas into the atmosphere.

48. A method for regenerating a particulate trap module with exhaust gas and for filtering particulate from the exhaust gas, comprising the steps of:

passing exhaust gas through a particulate trap module containing a plurality of tubular through flow passageways with porous walls at sufficient velocity to regenerate the particulate trap module wherein some of the exhaust gas is filtered during regeneration;

blocking at least one particulate trap module with at least one valve to increase the exhaust gas velocity to insure sufficient exhaust gas velocity to regenerate the particulate trap module or modules being regenerated;

directing the unfiltered or remaining exhaust gas to enter the opened ends of the blocked particulate trap module or modules wherein the pressure builds within the passageways forcing the remaining exhaust gas through the porous walls into the atmosphere and filtering out the soot and/or ash;

separating the eroded soot and/or ash from the flow of exhaust gas for external combustion and/or disposal; and periodically changing or alternating the exhaust flow through at least one particulate trap module by means of valves so that each particulate trap module is being addressed by the aforementioned regeneration process.

49. A method for filtering particulate from exhaust gas and for regenerating particulate trap modules, comprising the steps of:

positioning a particulate trap module to accept exhaust gas;

receiving the exhaust gas into a through flow passageways having porous walls, and wherein some of the exhaust gas is filtered through the porous walls;

directing the remaining exhaust gas into the open ends of blocked through flow passageways having porous walls for filtering; and controlling the flow of the exhaust gas at a sufficient velocity in the through flow passageways to erode and dislodge any build-up of particulate.

50. The method for filtering particulate from exhaust gas and for regenerating particulate trap modules in claim 49, further comprising the steps of:

directing the filtered exhaust gas from the porous walls toward a pressure relief valve, wherein the pressure relief valve will not allow the filtered exhaust gas to pass until a certain pressure is obtained thereby significantly increasing the exhaust gas velocity through the unblocked though flow passageways undergoing regeneration to dislodge accumulated soot and/or ash and wherein the pressure relief valve will allow exhaust gas to flow into an exhaust stack when a sufficient pressure is achieved.

51. The method for filtering particulate from exhaust gas and for regenerating particulate trap modules in claim 49, further comprising the steps of:

relieving pressure in the particulate trap system by incorporating a pressure relief valve prior to the particulate trap modules to prevent the build-up of excessive pressure within the particulate trap system.

52. The method for filtering particulate from exhaust gas and for regenerating particulate trap modules in claim 49, further comprising the steps of:

heating the flow of exhaust gas passing through the through flow passageways being regenerated to improve the erosion of soot and/or ash from the through flow passageways.

53. The method for filtering particulate from exhaust gas and for regenerating particulate trap modules in claim 51, further comprising the steps of:

applying catalyst to the particulate trap modules to facilitate the erosion of soot and/or ash from the particulate trap modules.

* * * * *

UNITED STATES PATENT AND TRADEMARK OFFICE

CERTIFICATE OF CORRECTION

PATENT NO. : 6,233,926 B1 
DATED : May 22, 2001
INVENTOR(S) : John M. Bailey and Donald J. Waldman It is certified that error appears in the above-identified patent and that said Letters Patent is hereby corrected as shown below:

Title page,
Item [57], ABSTRACT,
Line 11, please delete "Having" and insert -- Heating --

Drawings,
Please delete the drawing sheet containing Figs. 4a and 4b and insert the enclosed drawing sheet containing Figs. 4a and 4b.

Column 21,
Line 8, delete ";" and insert -- : --

Column 22,
Line 65, delete "passage way" and insert -- passageway --

Column 23,
Line 14, delete "to" and insert -- the --
Line 45, delete "passage ways" and insert -- passageways --
Line 62, delete "passage way" and insert -- passageway --

Column 27,
Line 36, delete "passage way" and insert -- passageway --

Column 30,
Line 9, delete "49" and insert -- 51 --

Signed and Sealed this

Twenty-fifth Day of June, 2002

*Attest:*

*Attesting Officer*

JAMES E. ROGAN
*Director of the United States Patent and Trademark Office*